US012317977B2

(12) United States Patent
Ma

(10) Patent No.: US 12,317,977 B2
(45) Date of Patent: Jun. 3, 2025

(54) TILT MECHANISMS AND ACTUATORS FOR UMBRELLAS

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 66 days.

(21) Appl. No.: 17/646,132

(22) Filed: Dec. 27, 2021

(65) Prior Publication Data

US 2022/0265013 A1 Aug. 25, 2022

Related U.S. Application Data

(63) Continuation of application No. 16/826,052, filed on Mar. 20, 2020, now Pat. No. 11,206,903.

(60) Provisional application No. 62/821,968, filed on Mar. 21, 2019.

(51) Int. Cl.
*A45B 17/00* (2006.01)
*A45B 25/14* (2006.01)

(52) U.S. Cl.
CPC ..... *A45B 25/14* (2013.01); *A45B 17/00* (2013.01)

(58) Field of Classification Search
CPC ..... A45B 17/00
See application file for complete search history.

(56) References Cited

U.S. PATENT DOCUMENTS

| | | | |
|---|---|---|---|
| 593,726 | A | 11/1897 | Nicholls |
| 680,661 | A | 8/1901 | Hunt |
| 835,306 | A | 11/1906 | Mangelsdorf |
| 878,270 | A | 2/1908 | Blake et al. |
| 956,657 | A | 5/1910 | Wetteroth |
| 957,528 | A | 5/1910 | Wetteroth |
| D45,227 | S | 2/1914 | Glauber |
| 1,136,887 | A | 4/1915 | Penn |
| 1,235,296 | A | 7/1917 | Dillingham |
| 1,243,594 | A | 10/1917 | Dillingham |
| 1,255,627 | A | 2/1918 | Morrow et al. |
| 1,268,354 | A | 6/1918 | Howard |
| 1,801,913 | A | 4/1931 | Frederick |
| 1,881,990 | A | 10/1932 | Zitzer |
| D90,772 | S | 9/1933 | Kasch |
| 1,972,653 | A | 9/1934 | Hart |
| 2,013,192 | A | 9/1935 | Sidney |
| 2,223,253 | A | 11/1940 | Hamilton |

(Continued)

FOREIGN PATENT DOCUMENTS

| | | |
|---|---|---|
| AT | 128258 | 5/1932 |
| BG | 6965-0001 | 4/2009 |

(Continued)

OTHER PUBLICATIONS

Operation Manual Easy Sun Parasol Sunshade (Issue: Jul. 2004) pp. 1-17.

(Continued)

*Primary Examiner* — Noah Chandler Hawk
(74) *Attorney, Agent, or Firm* — Knobbe, Martens, Olson & Bear, LLP

(57) ABSTRACT

A patio umbrella that includes a tilt mechanism for adjusting a shade angle of the umbrella canopy. The umbrella canopy can be opened and closed by a crank and spool mechanism. The tilt mechanism can be controlled by an actuator that operates independently of the crank and spool mechanism. The actuator can be mounted on the upright pole of the patio umbrella.

8 Claims, 26 Drawing Sheets

(56) References Cited

U.S. PATENT DOCUMENTS

D127,735 S 6/1941 Dreyfuss
2,341,399 A 2/1944 Timblin
2,447,972 A 8/1948 Weinert
2,462,560 A 2/1949 Edward
2,475,406 A 7/1949 Russell
D162,678 S 3/1951 Muller-Munk
D167,619 S 9/1952 Coran
2,661,012 A 12/1953 Militano
2,719,688 A 10/1955 Seifert
2,721,569 A 10/1955 Militano
2,745,421 A 5/1956 Russell
2,762,383 A 9/1956 Wittman
2,819,725 A 1/1958 Deisenroth et al.
RE24,477 E 5/1958 Small
D183,609 S 9/1958 Higgins
2,932,047 A 4/1960 Johnston
2,937,653 A 5/1960 Danciart et al.
D190,597 S 6/1961 Nelson
3,120,238 A 2/1964 Glatz
3,129,715 A 4/1964 Militano
3,142,307 A 7/1964 Danciart
3,145,720 A 8/1964 Torii
3,171,418 A 3/1965 Meyer
3,175,568 A * 3/1965 Kafka ..... A45B 17/00
192/48.91
3,177,882 A 4/1965 Militano
3,177,883 A 4/1965 Militano
3,253,310 A 5/1966 McCarthy
3,279,835 A 10/1966 Krohm
3,311,119 A 3/1967 Pearlstine
3,347,575 A 10/1967 Morris
3,395,717 A 8/1968 Weber
3,424,180 A 1/1969 Giancarlo
3,457,931 A 7/1969 Yoshio
3,521,651 A 7/1970 Pearlstine
D221,039 S 6/1971 Zimmerman
3,683,948 A 8/1972 Cohen
3,802,452 A 4/1974 Weber
3,856,032 A 12/1974 Schafer
D234,729 S 4/1975 Weber et al.
4,252,137 A 2/1981 Cohen
D265,498 S 7/1982 Paul
4,368,749 A 1/1983 Lindler et al.
4,385,849 A 5/1983 Crain
D276,838 S 12/1984 Hill et al.
4,586,525 A 5/1986 Glatz et al.
4,622,987 A 11/1986 Redl et al.
4,674,523 A 6/1987 Glatz
4,807,655 A 2/1989 Robertson
4,811,670 A 3/1989 Kolvites et al.
4,829,857 A 5/1989 Jones
4,878,509 A 11/1989 Tung
4,911,573 A 3/1990 Pietro
4,928,718 A 5/1990 Apple
4,993,445 A 2/1991 Dubinsky
5,002,081 A 3/1991 Stromeyer
5,020,557 A 6/1991 Apple
5,029,596 A 7/1991 Tung
5,050,627 A 9/1991 Hengtzu
5,174,319 A 12/1992 Chou et al.
5,186,197 A 2/1993 Lavine
5,284,171 A 2/1994 Liu
D344,786 S 3/1994 Short et al.
5,333,824 A 8/1994 Dubinsky
5,349,975 A 9/1994 Valdner
5,355,903 A 10/1994 Haddad et al.
5,357,994 A 10/1994 Chung
D366,826 S 2/1996 Heithaus
5,499,644 A 3/1996 Geniele
D372,854 S 8/1996 Jimenez
5,584,564 A 12/1996 Phyle
5,588,455 A 12/1996 Kuo
5,611,364 A 3/1997 Woods et al.
5,615,698 A 4/1997 Ko
5,617,888 A 4/1997 Wu
5,640,984 A 6/1997 Dubunsky
5,651,732 A 7/1997 Dufour
5,655,557 A 8/1997 Martin
5,740,823 A 4/1998 Lin et al.
5,740,824 A 4/1998 Tang
5,749,386 A 5/1998 Samuel, Jr.
5,779,386 A 7/1998 Eichhorn
5,785,069 A 7/1998 Glatz
D397,054 S 8/1998 Brantley et al.
D398,443 S 9/1998 Bolle
5,809,734 A 9/1998 Turner
5,816,276 A 10/1998 Seidel et al.
D400,777 S 11/1998 Carsello
5,836,328 A 11/1998 Lee
5,871,024 A 2/1999 Vanderminden, Sr.
5,884,645 A 3/1999 Chen et al.
D408,621 S 4/1999 Kuo
5,899,210 A 5/1999 Letherby et al.
D410,862 S 6/1999 Milhov
5,921,115 A 7/1999 Winner
5,937,882 A 8/1999 Harbaugh
6,014,980 A 1/2000 Glatz
D424,799 S 5/2000 Lai
6,082,383 A 7/2000 Wilson
6,129,101 A 10/2000 Dubinsky
D434,215 S 11/2000 Lin
D434,476 S 11/2000 Meda
6,145,523 A 11/2000 Lo
6,152,156 A 11/2000 Tung
D434,556 S 12/2000 Lin
6,170,497 B1 1/2001 Ma
6,192,907 B1 2/2001 Wu
6,216,712 B1 4/2001 Lin et al.
6,220,261 B1 4/2001 Glatz
6,230,728 B1 5/2001 Reese
6,247,483 B1 6/2001 Rung
6,305,394 B1 10/2001 Reese
6,311,705 B1 11/2001 Ma
6,311,707 B1 11/2001 Wu et al.
6,314,976 B1 11/2001 Clarke
6,345,639 B2 2/2002 Rousselle et al.
6,371,141 B1 4/2002 Lin et al.
6,371,686 B1 4/2002 Wu
6,374,840 B1 4/2002 Ma
6,386,214 B1 5/2002 Clarke
6,386,215 B1 5/2002 Chang
D458,904 S 6/2002 Montena
6,412,506 B1 7/2002 Reese
6,422,251 B1 7/2002 Tseng
6,446,650 B1 9/2002 Ma
6,478,037 B2 11/2002 Tung
6,516,820 B1 2/2003 Earnshaw
6,571,813 B2 6/2003 Lin et al.
6,575,182 B2 6/2003 Tung
6,575,183 B2 6/2003 Tung
D477,458 S 7/2003 Goldwitz
6,588,438 B1 7/2003 Steiner
6,595,713 B1 7/2003 Wilson
D478,416 S 8/2003 Clarke
6,619,306 B2 9/2003 Ma
6,662,815 B2 12/2003 Tung
D484,680 S 1/2004 You
D489,169 S 5/2004 You
D489,170 S 5/2004 You
D489,967 S 5/2004 Funk
6,732,753 B2 5/2004 Chang
6,758,229 B2 7/2004 Wang
D497,478 S 10/2004 Clarke
D497,479 S 10/2004 Yu
6,810,895 B2 11/2004 Lin et al.
6,837,255 B2 1/2005 Bunch et al.
6,848,459 B2 2/2005 Ma
6,851,823 B2 2/2005 Bilotti
D503,035 S 3/2005 Ko
6,889,699 B2 5/2005 Clarke
6,920,887 B2 7/2005 Lo
6,941,960 B2 9/2005 Huang
D515,803 S 2/2006 You
7,000,624 B2 2/2006 Chang

(56) References Cited

U.S. PATENT DOCUMENTS

| | | | |
|---|---|---|---|
| D525,721 | S | 7/2006 | Landes |
| 7,082,953 | B2 | 8/2006 | Liu |
| 7,089,950 | B2 | 8/2006 | Lin |
| D532,947 | S | 11/2006 | Muscarella |
| 7,182,713 | B2 | 2/2007 | Wang |
| D539,632 | S | 4/2007 | Ma |
| 7,204,261 | B1 | 4/2007 | Wu |
| 7,255,118 | B2 | 8/2007 | Ma |
| 7,281,542 | B2 | 10/2007 | Ko |
| D555,349 | S | 11/2007 | You |
| 7,293,573 | B2 | 11/2007 | Clarke |
| D558,444 | S | 1/2008 | Ma |
| 7,318,444 | B2 | 1/2008 | Clakre |
| 7,328,715 | B2 | 2/2008 | Neubardt |
| 7,412,985 | B2 | 8/2008 | Ma |
| D586,549 | S | 2/2009 | Hermanson et al. |
| D586,550 | S | 2/2009 | Hermanson et al. |
| D587,448 | S | 3/2009 | You |
| 7,546,845 | B2 | 6/2009 | Prusmack |
| D600,439 | S | 9/2009 | Zonsius |
| 7,600,734 | B2 | 10/2009 | Clarke |
| 7,665,477 | B1 | 2/2010 | Hathaway |
| 7,686,024 | B1 | 3/2010 | Lai |
| 7,703,464 | B2 | 4/2010 | Ma |
| 7,775,226 | B2 | 8/2010 | MacDonald et al. |
| 7,806,130 | B2 | 10/2010 | Gobel |
| D631,243 | S | 1/2011 | Forthuber et al. |
| 7,861,734 | B2 | 1/2011 | Ma |
| 7,891,367 | B2 | 2/2011 | Ma |
| 7,900,643 | B2 | 3/2011 | Ma |
| 7,913,708 | B2 | 3/2011 | Yung |
| 7,913,709 | B2 | 3/2011 | Brebner |
| D637,388 | S | 5/2011 | You |
| D640,464 | S | 6/2011 | Forthuber et al. |
| 7,980,262 | B1 | 7/2011 | You |
| 8,020,572 | B2 | 9/2011 | Ma |
| 8,053,042 | B1 | 11/2011 | Loomis |
| 8,061,375 | B2 | 11/2011 | Ma |
| D650,984 | S | 12/2011 | Pineda |
| 8,082,935 | B2 | 12/2011 | Ma |
| 8,087,420 | B1 | 1/2012 | Lukacsy |
| 8,096,310 | B2 | 1/2012 | Clarke |
| 8,100,139 | B2 | 1/2012 | Chong |
| D664,760 | S | 8/2012 | Elder |
| 8,272,391 | B2 | 9/2012 | Luo |
| 8,298,633 | B1 | 10/2012 | Chen |
| 8,443,819 | B2 | 5/2013 | Beaulieu |
| 8,522,804 | B1 | 9/2013 | Tung |
| D704,044 | S | 5/2014 | Makino |
| 8,757,183 | B2 | 6/2014 | Volin |
| D714,132 | S | 9/2014 | Hazantonis |
| 8,899,250 | B1 | 12/2014 | Tung |
| D727,469 | S | 4/2015 | Jorgensen |
| 9,004,087 | B2 | 4/2015 | Ma |
| D731,166 | S | 6/2015 | Ma |
| 9,060,576 | B2 | 6/2015 | Siegenthaler |
| 9,113,683 | B2 | 8/2015 | Ma |
| D753,271 | S | 4/2016 | LaBarbera et al. |
| D759,955 | S | 6/2016 | Ma |
| D759,956 | S | 6/2016 | McQuaid |
| 9,504,298 | B2 | 11/2016 | Li |
| 9,844,288 | B2 | 12/2017 | Fu |
| D818,697 | S | 5/2018 | Ma |
| 10,016,033 | B2 | 7/2018 | Volin |
| 10,562,172 | B1 | 2/2020 | Armstrong |
| 10,736,390 | B2 | 8/2020 | Ma |
| 10,758,015 | B2 | 9/2020 | Ma |
| 10,945,381 | B1 | 3/2021 | Pringnitz |
| 11,123,857 | B1 | 9/2021 | Ramsey |
| 11,206,903 | B2 | 12/2021 | Ma |
| 11,388,963 | B2 | 7/2022 | Ma |
| 11,771,186 | B2 | 10/2023 | Ma |
| D1,003,592 | S | 11/2023 | Ma |
| 12,167,782 | B2 | 12/2024 | Ma |
| 12,207,714 | B2 | 1/2025 | Ma |
| 2001/0017150 | A1 | 8/2001 | Doreste |
| 2002/0083969 | A1 | 7/2002 | Tung |
| 2002/0139405 | A1 | 10/2002 | Lee |
| 2003/0010367 | A1 | 1/2003 | Ko |
| 2003/0015230 | A1 | 1/2003 | Glatz |
| 2003/0062073 | A1 | 4/2003 | Tung |
| 2004/0031513 | A1 | 2/2004 | Bunch et al. |
| 2004/0055627 | A1 | 3/2004 | P. Moga |
| 2004/0055628 | A1 | 3/2004 | Yu |
| 2004/0069333 | A1 | 4/2004 | Ma |
| 2004/0154525 | A1 | 8/2004 | Wirth et al. |
| 2004/0182429 | A1 | 9/2004 | Chen |
| 2004/0187900 | A1 | 9/2004 | Earnshaw |
| 2004/0206382 | A1 | 10/2004 | Clarke |
| 2004/0206383 | A1 | 10/2004 | Clarke |
| 2005/0045217 | A1 | 3/2005 | Clarke |
| 2005/0081902 | A1 | 4/2005 | Liu |
| 2005/0098200 | A1 | 5/2005 | Su |
| 2005/0238422 | A1 | 10/2005 | Hung |
| 2005/0279520 | A1 | 12/2005 | Newman et al. |
| 2006/0005867 | A1 | 1/2006 | Chang |
| 2006/0005868 | A1 | 1/2006 | Fenton |
| 2006/0046899 | A1 | 3/2006 | Wang |
| 2006/0070644 | A1 | 4/2006 | Schneller |
| 2006/0151019 | A1 | 7/2006 | Lo |
| 2007/0113878 | A1 | 5/2007 | Ko |
| 2007/0261728 | A1 | 11/2007 | Lin |
| 2008/0041433 | A1 | 2/2008 | Caldwell |
| 2008/0202570 | A1 | 8/2008 | Clarke |
| 2009/0126769 | A1 | 5/2009 | Hoogendoorn |
| 2009/0242065 | A1 | 10/2009 | Whitling et al. |
| 2010/0139724 | A1 | 6/2010 | Lai |
| 2010/0139725 | A1 | 6/2010 | Lai |
| 2011/0061694 | A1 | 3/2011 | Vanderminden, Sr. |
| 2011/0132418 | A1 | 6/2011 | Ma |
| 2011/0209732 | A1 | 9/2011 | Ma |
| 2011/0214705 | A1 | 9/2011 | Ma |
| 2011/0241389 | A1 | 10/2011 | Tsai |
| 2011/0277800 | A1 | 11/2011 | Tung |
| 2012/0126533 | A1 | 5/2012 | Canale |
| 2012/0155958 | A1 | 6/2012 | Donohue |
| 2014/0109942 | A1 | 4/2014 | Ma |
| 2014/0305476 | A1 | 10/2014 | Ma |
| 2014/0376990 | A1 | 12/2014 | Lai |
| 2015/0237976 | A1 | 8/2015 | Chow |
| 2018/0298632 | A1 | 10/2018 | Ma |
| 2019/0082802 | A1 | 3/2019 | Ma |
| 2019/0203497 | A1 | 7/2019 | Mummert et al. |
| 2019/0323531 | A1 | 10/2019 | Wang |
| 2020/0297085 | A1 | 9/2020 | Ma |
| 2020/0384328 | A1 | 12/2020 | Chua |
| 2021/0112932 | A1 | 4/2021 | Ma |
| 2022/0125169 | A1 | 4/2022 | Ma |
| 2022/0400822 | A1 | 12/2022 | Ma |
| 2023/0018195 | A1 | 1/2023 | Ma |
| 2023/0270216 | A1 | 8/2023 | Ma |

FOREIGN PATENT DOCUMENTS

| | | |
|---|---|---|
| CN | 2579212 | 10/2003 |
| CN | 202060155 | 12/2011 |
| CN | 202190859 | 4/2012 |
| CN | 202588579 | 12/2012 |
| CN | 202636818 | 1/2013 |
| CN | 203168230 | 9/2013 |
| CN | 204181115 | 3/2015 |
| CN | 106889721 | 4/2017 |
| CN | 208280719 | 12/2018 |
| CN | 210581325 U | 5/2020 |
| CN | 211229881 | 8/2020 |
| DE | 22 04 217 | 8/1973 |
| DE | 24 34 495 | 2/1975 |
| DE | 3820573 | 8/1989 |
| DE | 29516009 | 11/1995 |
| DE | 202010011240 | 11/2010 |
| DE | 202012007364 | 11/2012 |
| DE | 202017002887 | 7/2017 |
| DE | 202019103816 | 7/2019 |
| EP | 0 628 264 | 12/1994 |

(56) References Cited

FOREIGN PATENT DOCUMENTS

| | | | |
|---|---|---|---|
| EP | 1 302 120 | | 3/2005 |
| EP | 1 510 145 | | 3/2005 |
| EP | 2 289 364 | | 3/2011 |
| EP | 007772157-0001 | | 3/2020 |
| EP | 4 118 998 | | 1/2023 |
| FR | 2612551 | | 9/1988 |
| FR | 2672781 | A3 | 8/1992 |
| JP | 58-107024 | | 7/1983 |
| JP | S61-37814 | | 3/1986 |
| JP | H08-322621 | | 12/1996 |
| JP | 2000-139533 | | 5/2000 |
| JP | 2001-046131 | | 2/2001 |
| JP | 2006-110317 | A | 4/2006 |
| JP | 2007-222591 | | 9/2007 |
| JP | 2008-142310 | | 6/2008 |
| JP | 3144314 | | 7/2008 |
| JP | 2009-045359 | | 3/2009 |
| JP | 2009-247750 | | 10/2009 |
| WO | WO 2005/058089 | | 6/2005 |
| WO | WO 2007/092514 | | 8/2007 |
| WO | WO 2013/013474 | | 1/2013 |
| WO | WO 2018/084181 | | 5/2018 |

OTHER PUBLICATIONS

Amazon.com, Site visited Feb. 7, 2023, ITT AHO Heavy Duty Telescoping Extension Pole, First available Dec. 21, 2019, https://us.amazon .com/ITTAHO-Aluminum-Telescopic-Extension-Telescoping/dp/B07ZT8M9VD (Year: 2019).

Shadeaustralia.com.au, Site visited Jan. 23, 2023, Shelta Como Umbrella, oldest review dated Dec. 7, 2017, https://www.shadeaustralia.com.au/como-timber-umbrella (Year: 2017).

Youtube.com, Site visited Jan. 24, 2023, "Cool Pool Products Umbrella Sleeve," published on Jul. 19, 2019 by CoolPoolProducts: https:// www .youtube.com/watch?v=x_qAK8QDJ Ko&list=TLGGy0td2PTduXUyNDAxMjAyMw (Year: 2019).

Youtube.com, Site visited Feb. 10, 2023, "Testrite Telescopic Tubing and Locks," published by Testrite on Sep. 26, 2017 features the FA Spring Button A-Clutch Lock: https://www.youtube.com/watch?v=Lp2uGtOGZRA (Year: 2017).

* cited by examiner

TILT MECHANISMS AND ACTUATORS FOR UMBRELLAS

CROSS REFERENCE

This application is a continuation of U.S. patent application Ser. No. 16/826,052, filed Mar. 20, 2020, which claims the benefit of U.S. Patent Application No. 62/821,968, filed Mar. 21, 2019, the entirety of which is hereby incorporated by reference.

BACKGROUND

Field

The present invention generally relates to umbrellas and in particular to tilt devices and actuators used to orient canopy assemblies of the umbrellas.

Related Art

Umbrellas have become increasingly popular in recent years and have found their way into residential and commercial establishments in the form of large, patio umbrellas. One desirable feature of a patio umbrella is a tilt mechanism for the canopy assembly of the umbrella. The tilt mechanism can be used to orient the canopy assembly towards the sun. The tilt mechanism can adjust the location of shade provided by the umbrella depending on the position of the sun.

SUMMARY

According to one aspect of an umbrella, the umbrella includes a upright pole. The upright pole includes an upper pole portion and a lower pole portion; a canopy assembly includes the upper pole portion. A first mechanism opens and closes the canopy assembly. A second mechanism adjusts an angle between the upper pole portion and the lower pole portion. An actuator for the second mechanism couples with the lower pole portion and adjusts the tilt mechanism between a first configuration and a second configuration. The second configuration is tilted relative to the first configuration.

According to another aspect of certain embodiments of the umbrella, the second mechanism further includes: an upper coupler attached with the upper pole portion, a lower coupler attached with the lower pole portion, and the upper and lower couplers attached at a pivot. A guide track assembly includes a channel having a camming surface disposed in the upper coupler. A driver has an upper end and a lower end. The upper end is disposed in the guide track assembly and is guided by the channel. The lower end couples with the actuator by a tension member. From the first configuration, downward movement of the driver engages the upper end of the driver with the camming surface and tilts the upper pole portion relative to the lower pole portion about the pivot. From the second configuration, upward movement of the driver engages the upper end of the driver with the camming surface and aligns the upper pole portion relative to the lower pole portion.

According to another aspect of certain embodiments of the umbrella, the tilt mechanism further includes a spring. The spring biases the tilt mechanism in the first configuration.

According to another aspect of certain embodiments of the umbrella, the actuator includes a sleeve slidingly engaged with the upright pole between a raised position and a lowered position. The sleeve couples with the tilt mechanism by a tension member. A hook member couples with the sleeve. The hook member is biased to engage with a catch in the lowered position of the sleeve. The hook member is releasable from the catch by a button on the sleeve. Moving the sleeve into the lowered position actuates the second mechanism into the second configuration. Releasing the sleeve from the lowered position by pressing the bottom returns the second mechanism into the first configuration.

According to another aspect of certain embodiments of the umbrella, the actuator includes a sleeve slidingly engaged with the upright pole between a raised position and a lowered position. The sleeve couples with the second mechanism by a tension member. The sleeve includes an upper sleeve portion and a lower sleeve portion. The upper and lower sleeve portions couple together by a sliding catch. A hook member couples with the lower sleeve portion. The hook member is biased to engage with a catch in the lowered position of the sleeve. An internal projection extends from the upper sleeve portion. The internal projection engages with an angled end of the hook member. Relative movement of the upper sleeve portion relative to the lower sleeve portion engages the internal projection with the angled end of the hook member to release the hook member from the catch. Moving the sleeve into the lowered position actuates the second mechanism into the second configuration. Releasing the sleeve from the lowered position by movement of the upper sleeve portion relative to the lower sleeve portion returns the second mechanism into the first configuration.

According to another aspect of certain embodiments of the umbrella, the relative movement of the upper sleeve portion is upward movement.

According to another aspect of certain embodiments of the umbrella, the actuator includes a sliding driver slidingly engaged along a channel between a raised position and a lowered position. The sliding driver couples with the tilt mechanism by a tension member. A transverse pin couples with the sleeve. The transverse pin is biased to engage with a catch in the lowered position of the sliding driver. The transverse pin is releasable from the catch by an outward movement of the pin. Moving the sliding driver into the lowered position actuates the second mechanism into the second configuration. Releasing the sliding driver from the lowered position returns the second mechanism into the first configuration.

According to another aspect of certain embodiments of the umbrella, the transverse pin is releasable from the catch by an outward rotation of the sliding driver.

According to another aspect of certain embodiments of the umbrella, the actuator includes a pivot handle. The pivot handle is pivotable with respect to the upright pole between a raised position and a lowered position. The pivot handle couples with the second mechanism by the tension member. A positioning surface is adjacent to the pivot handle. The positioning surface includes at least one tilt position feature. An engagement pin is biased to engage with the at least one tilt position feature in the lowered position of the pivot handle. The pivot handle is releasable from the positioning surface by disengagement of the pin from the tilt position feature of the positioning surface. Moving the pivot handle into the lowered position actuates the second mechanism into the second configuration. Releasing the pivot handle from the lowered position returns the second mechanism into the first configuration.

According to another aspect of certain embodiments of the umbrella, the positioning surface is a ratchet and/or the at least one tilt position feature is at least one tooth.

According to another aspect of certain embodiments of the umbrella, the actuator includes a pivot handle. The pivot handle pivots with respect to the upright pole between a lowered position and a raised position. The pivot handle couples with the second mechanism by the tension member. A housing is adjacent to the pivot handle. The housing includes a projection that engages with a corresponding divot in the pivot handle in the raised position. The pivot handle is releasable from the raised position by disengagement of the projection and divot. Moving the pivot handle into the raised position actuates the second mechanism into the second configuration. Releasing the pivot handle from the raised position returns the second mechanism into the first configuration.

According to another aspect of certain embodiments of the umbrella, the actuator has a grip handle that is moved between a raised position and a lowered position. The grip handle couples with the tilt mechanism. The grip handle moving into the lowered position actuates the second mechanism into the second configuration. Releasing the grip handle from the lowered position returns the second mechanism into the first configuration.

According to another aspect of certain embodiments of the umbrella, the actuator the movement of the grip handle from the lowered position to the raised position disengaged a locking device disposed within an inner space of the grip handle.

According to another aspect of certain embodiments of the umbrella, a housing couples with the upright pole and the actuator is slideable in a slot formed in the housing between a first position at a first end of the slot and a second position at a second end of the slot. The first position of the slideable actuator actuates the upper pole portion and the canopy assembly into a more upright configuration. The second position of the slideable actuator actuates the upper pole portion and the canopy assembly into a more tilted configuration.

According to another aspect of certain embodiments of the umbrella, the slideable actuator can rotate about an axis transverse to a longitudinal axis of the upright pole to retract an engagement member thereof away from a catch disposed at the first end of the slot or the second end of the slot or both.

According to another aspect of certain embodiments of the umbrella, the actuator has a pivot handle pivotably coupled with the upright pole. A cord has a first end coupled with the tilt mechanism and a second end coupled with the pivot handle.

According to another aspect of certain embodiments of the umbrella, the pivot handle is pivotably coupled with the upright pole at a diameter thereof.

According to another aspect of certain embodiments of the umbrella, the pivot handle has a linkage comprising a free end disposed outside the pole and a pivotable link coupled to the pivot handle at one end and to the cord at an opposite end.

According to another aspect of certain embodiments of the umbrella, the pivot handle couples with a positioning surface coupled to an outside surface of the upright pole.

According to another aspect of certain embodiments of the umbrella, the positioning surface has a series of tilt position features.

According to another aspect of certain embodiments of the umbrella, the pivot handle has an engagement member resiliently biased toward the tilt position features.

According to another aspect of certain embodiments of the umbrella, the pivot handle has a first end disposed outside the upright pole, a second end opposite the first end, and a central portion disposed between the first end and the second end, the central portion being pivotably coupled to a housing coupled with a side surface of the upright pole According to another aspect of certain embodiments of the umbrella, the housing has at least two protrusions and the pivot handle has at least one divot. A first of the at least two protrusions engages the at least one divot when the first mechanism is in the first configuration. A second of the at least two protrusions engages the at least one divot when the first mechanism is in the second configuration. The first protrusion is below the second protrusion.

According to another aspect of certain embodiments of the umbrella, the central portion of the pivot handle is pivotable in a slot of the housing. The at least two protrusions are formed on one or more surfaces bounding the slot.

According to another aspect of certain embodiments of the umbrella, the actuator includes a pivot handle that moves between a raised position and a lowered position. The pivot handle couples with the tilt mechanism by a tension member. An engagement member of the pivot handle engages with a catch in the raised or lowered position. The pivot handle is releasable from the raised and lowered position by disengagement of the engagement member from the catch. Moving the pivot handle into the raised or lowered position actuates the second mechanism into the second configuration. Releasing the pivot handle from the other one of the raised or lowered positions returns the second mechanism into the first configuration.

BRIEF DESCRIPTION

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

I. Umbrella With a Dedicated Tilt Mechanism

Figure 1A:
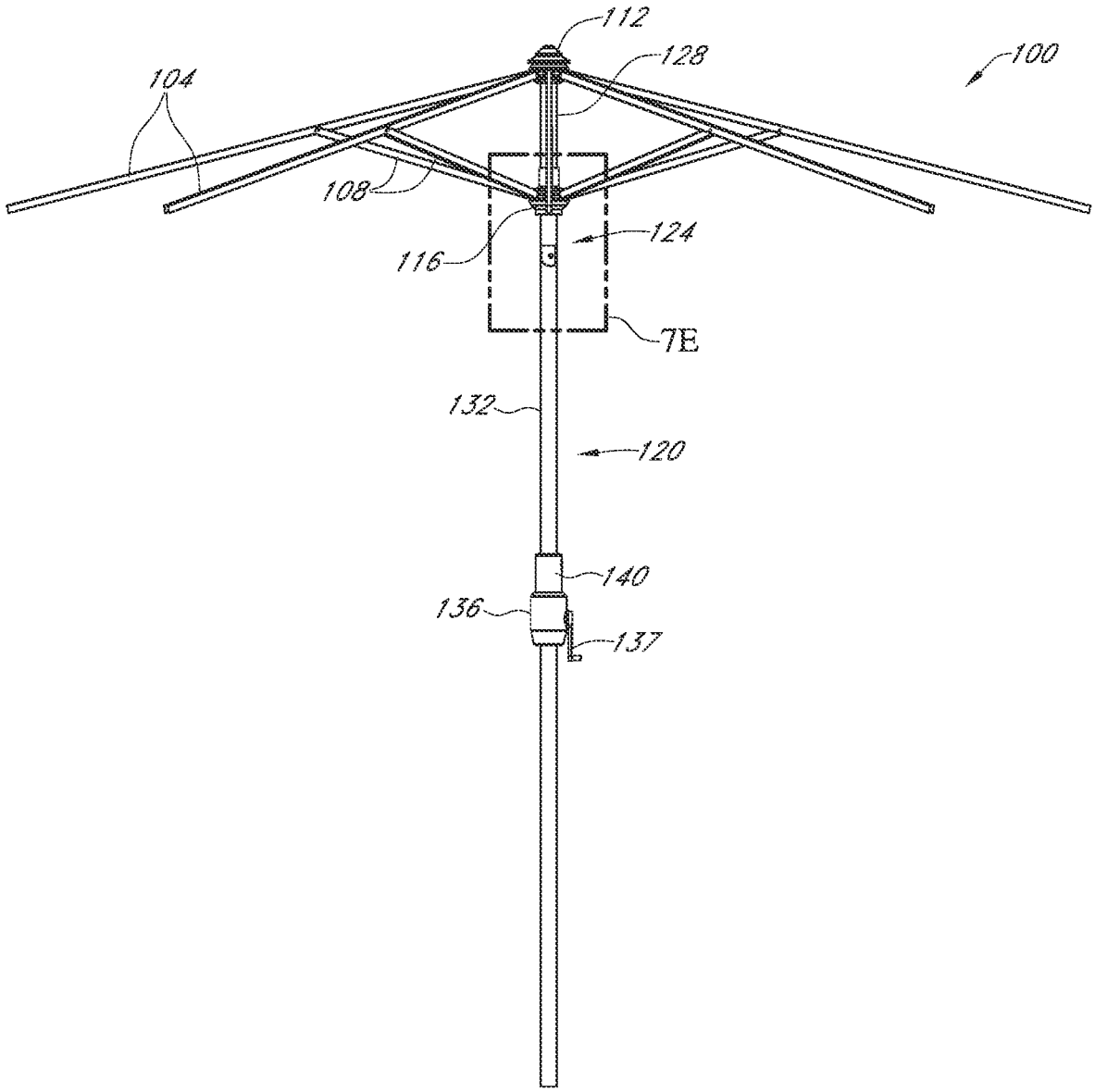
FIG. 1A shows an umbrella with a tilt mechanism and actuator in an untilted configuration.
Figure 1B:
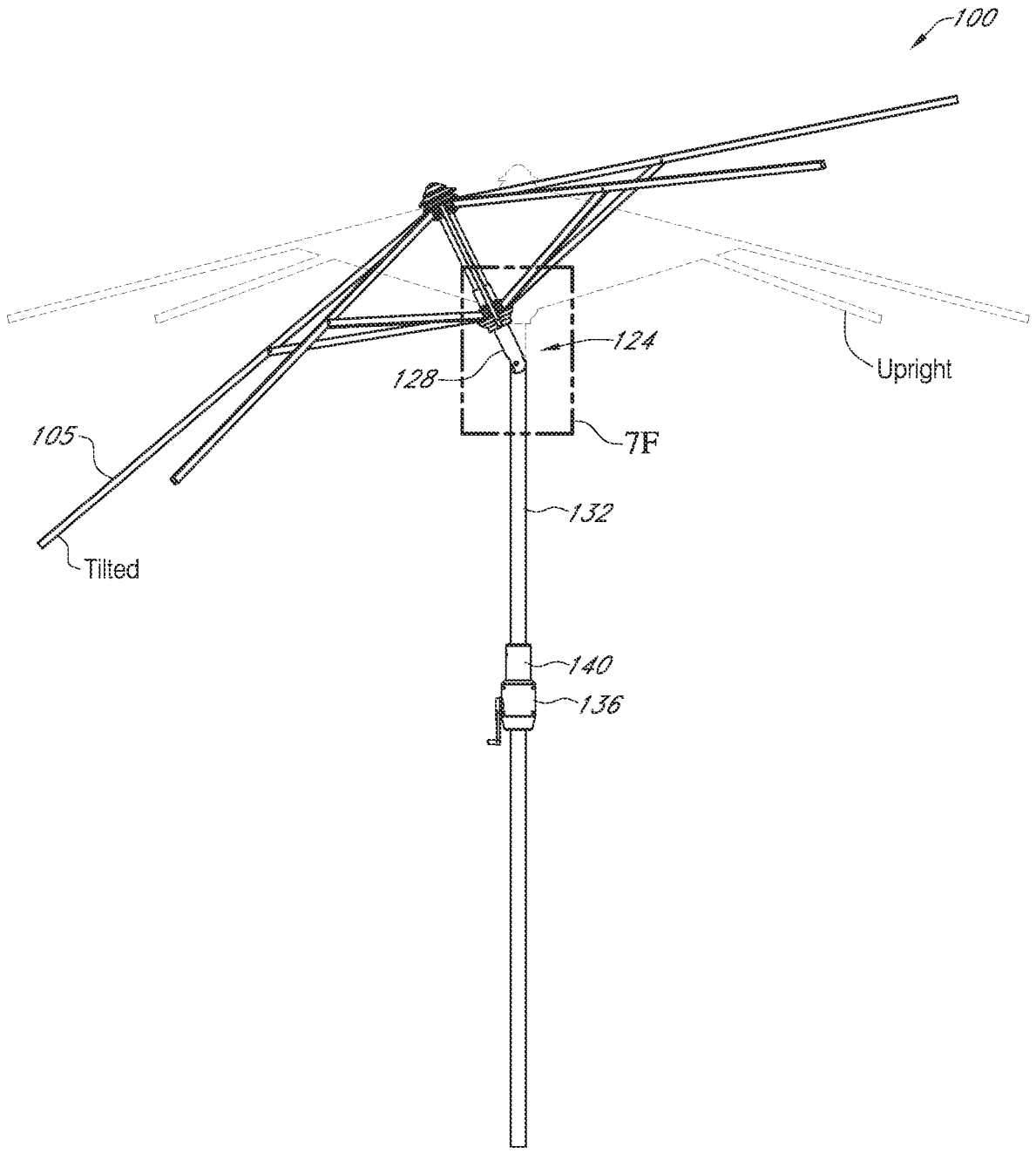
FIG. 1B shows the umbrella of FIG. 1A in a tilted configuration.

FIGS. 1A and 1B illustrate an umbrella 100. The umbrella 100 can include a canopy assembly. The canopy assembly can include plurality of ribs 104 and a plurality of corresponding struts 108. The ribs 104 and struts 108 can provide support to a canopy member or fabric 105 (shown in FIG. 1B). The canopy fabric 105 can provide shade and/or protection from the weather for persons and objects located underneath the canopy fabric 105. The canopy fabric 105 can be formed of canvas, plastic mesh, or other sheet material. The ribs 104, the struts 108, and the canopy fabric 105 may be described herein collectively as part of a canopy assembly.

An inner end of each of the ribs 104 can be pivotably coupled with an upper hub 112. The upper hub 112 can be coupled with a central pole 120. One end of each of the struts 108 can be pivotably coupled with a lower hub 116. The lower hub 116 can be slideably mounted on the central pole 120. An opposite end of each of the struts 108 can be pivotably coupled with a corresponding rib of the ribs 104. The canopy assembly of the umbrella 100, which can also include the hubs 112, 116, can be opened and closed by movement of the lower hub 116 along the central pole 120. The canopy assembly can be opened by raising the lower hub 116 along the central pole 120. The canopy assembly can be closed by lowering the lower hub 116 along the central pole 120.

The umbrella 100 can include an opening and closing mechanism 136, which can be a first mechanism of the umbrella 100. The opening and closing mechanism 136 is sometimes referred to herein by the shorthand open/close mechanism 136. The opening and closing mechanism 136 can be mounted on the central pole 120. The opening and closing mechanism 136 can control the position of the lower hub 116 along the central pole 120. The open/close mechanism 136 can include a crank handle attached to a spool (not shown). The spool can be attached to a tension transferring member (not shown), such as a string, a wire, a cord, or other similar member configured to transfer a force to one or both of the hubs 112, 116 and also configured to be wound on the spool. The cord or other tension transferring member can be coupled at one end with the spool and at an opposite end with the lower hub 116. The cord can pass over a pulley located adjacent to or supported within the upper hub 112. By turning the spool using the crank handle 137, the winding or unwinding of the cord can correspondingly raise or lower the lower hub 116 and open or close the canopy assembly of the umbrella 100.

The umbrella 100 includes a tilt mechanism 124, which can be a second mechanism of the umbrella 100. The tilt mechanism 124 can be a dedicated mechanism that is provided to adjust the tilt angle of the canopy assembly or components thereof, as discussed further below. As used herein, a dedicated mechanism is one that can provide only the tilt function as described herein. As used herein, a dedicated mechanism is one that provides the tilt function separate and apart form the open/close function of the canopy assembly. The tilt mechanism 124 can be mounted along the central pole 120. Alternatively, the tilt mechanism 124 can be used in a cantilever style umbrella. The tilt mechanism 124 can divide the central pole 120 into an upper pole portion 128 and a lower pole portion 132. The upper pole portion 128 can be coupled with an upper end or an upper portion of the tilt mechanism 124. The upper hub 112 can be coupled with upper pole portion 128. The lower pole portion 132 can be coupled with a lower end or lower portion of the tilt mechanism 124. Further details of tilt mechanisms for umbrellas are described in U.S. Pat. Pub. No. 2018/0298632 (Ma) and U.S. Pat. No. 6,446,650 (Ma), which are hereby incorporated herein by reference for purposes of further description of the upper and lower portions of tilt mechanism and for all other purposes.

Figure 7A:
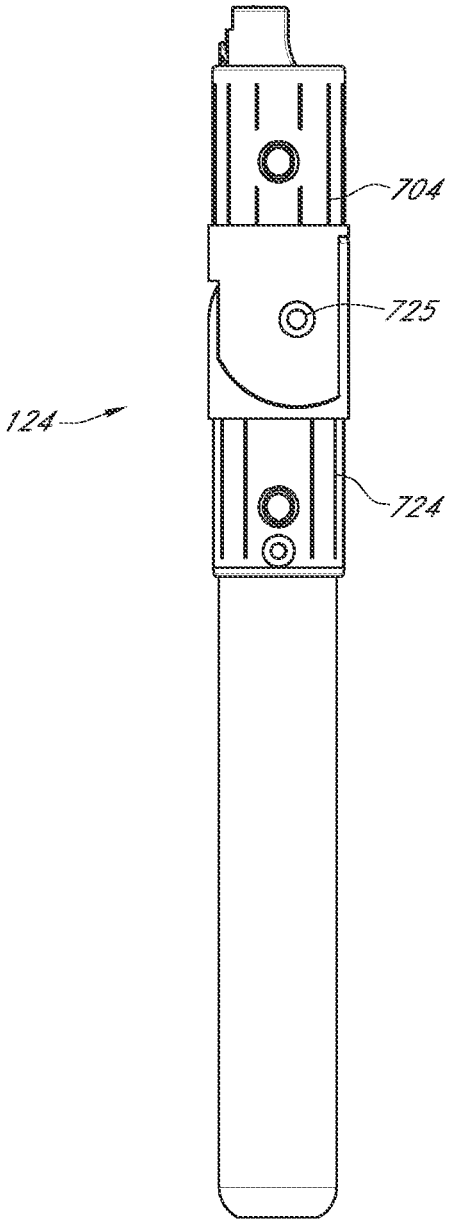
FIG. 7A shows an embodiment of the tilt mechanism of the umbrella of FIGS. 1A and 1B.
Figure 7B:
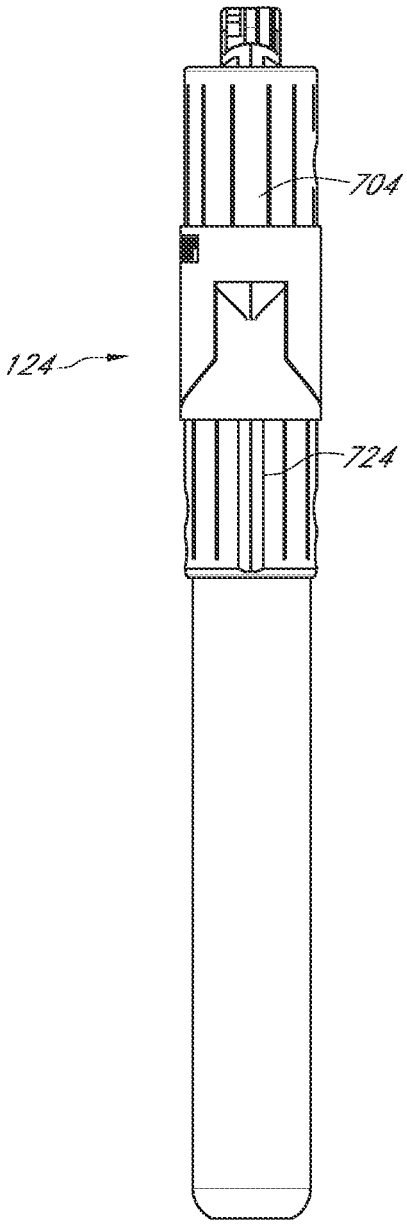
FIG. 7B shows a side view of the tilt mechanism of FIG. 7A.
Figure 7C:
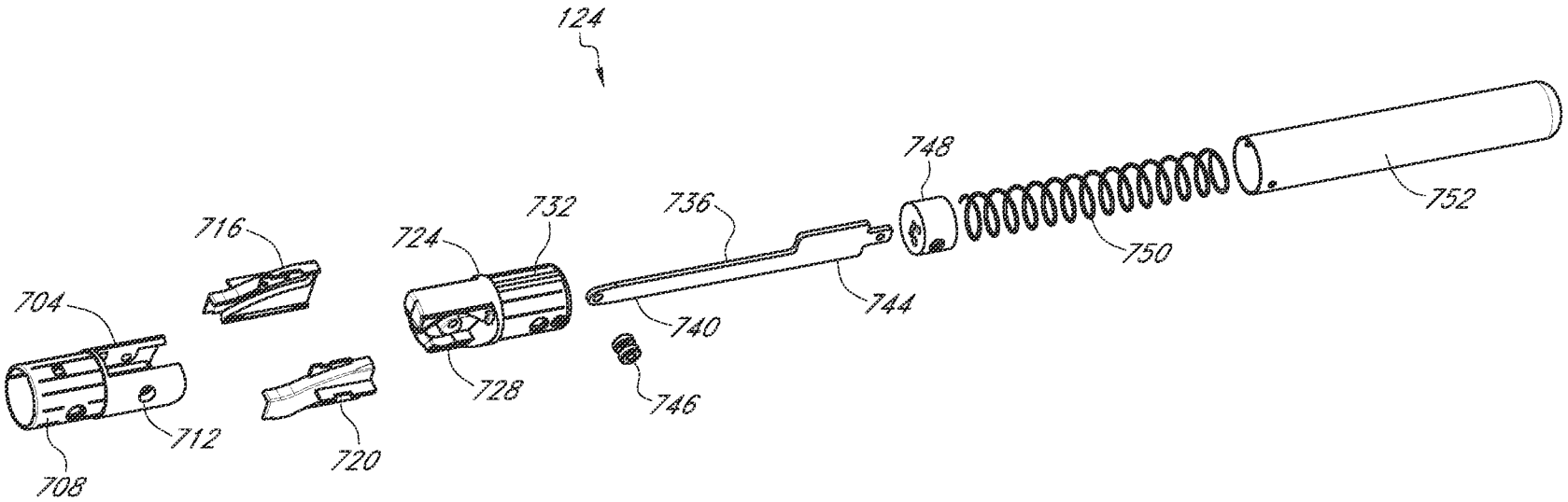
FIG. 7C shows an exploded view of the tilt mechanism of FIG. 7A.
Figure 7D:
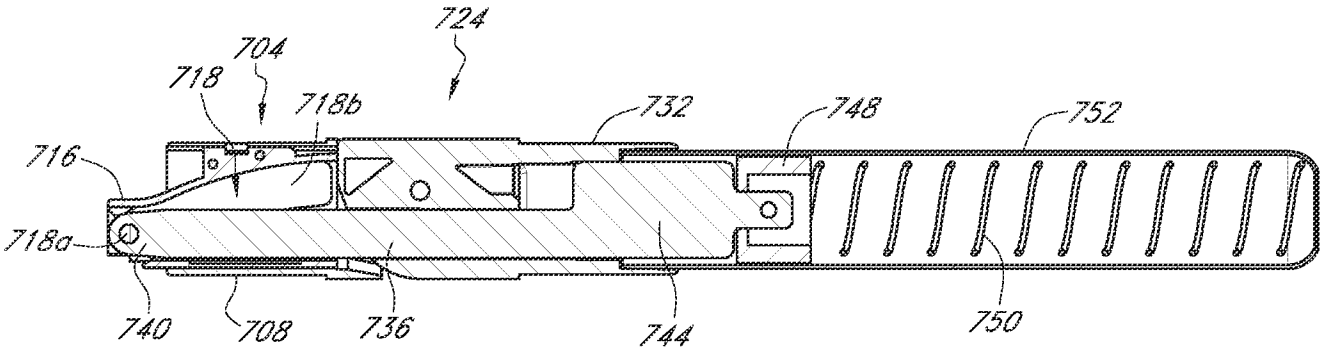
FIG. 7D shows a cross section of the tilt mechanism of FIG. 7A.
Figure 7E:
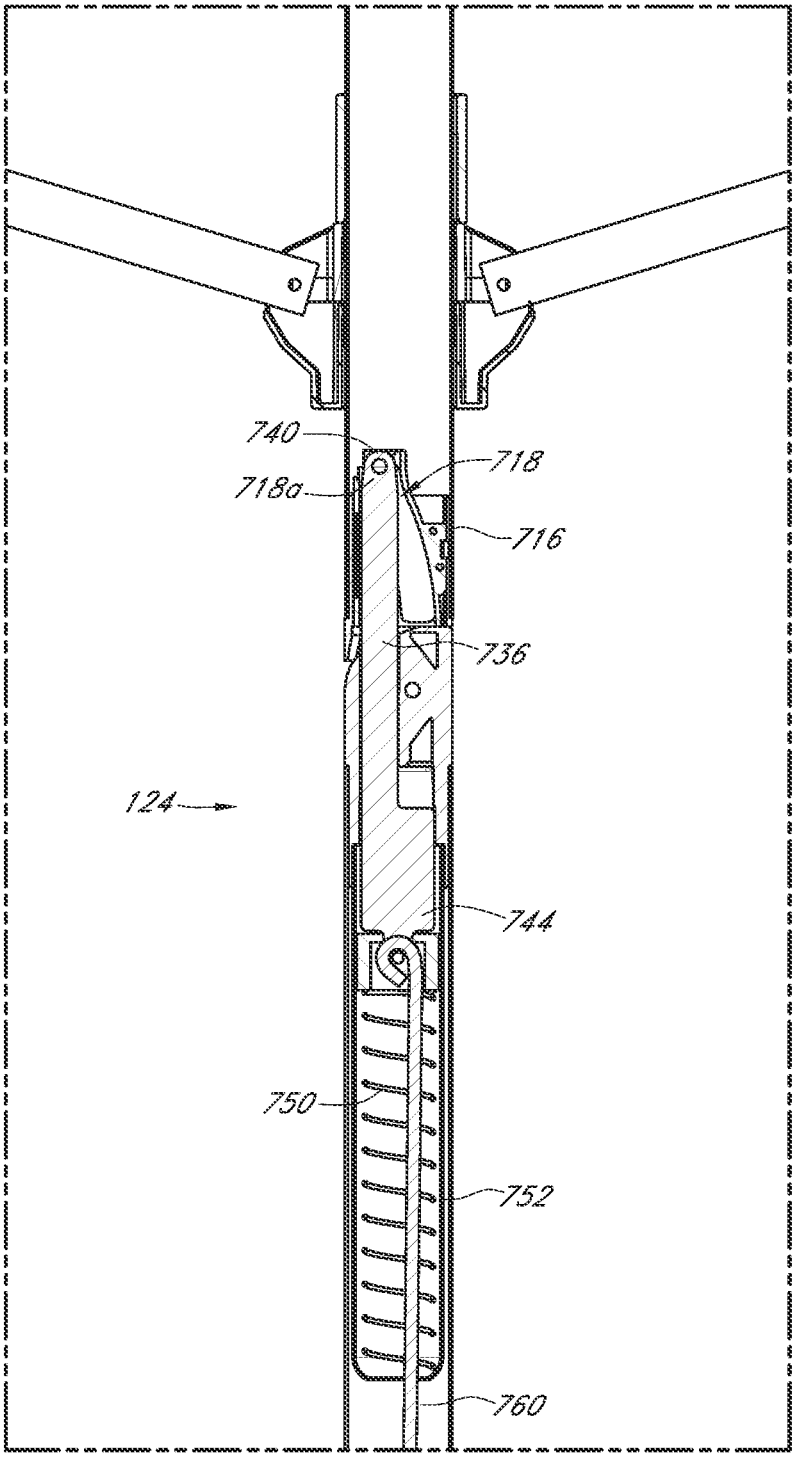
FIG. 7E shows a cross section of the tilt mechanism of FIG. 7A in an untilted configuration.
Figure 7F:
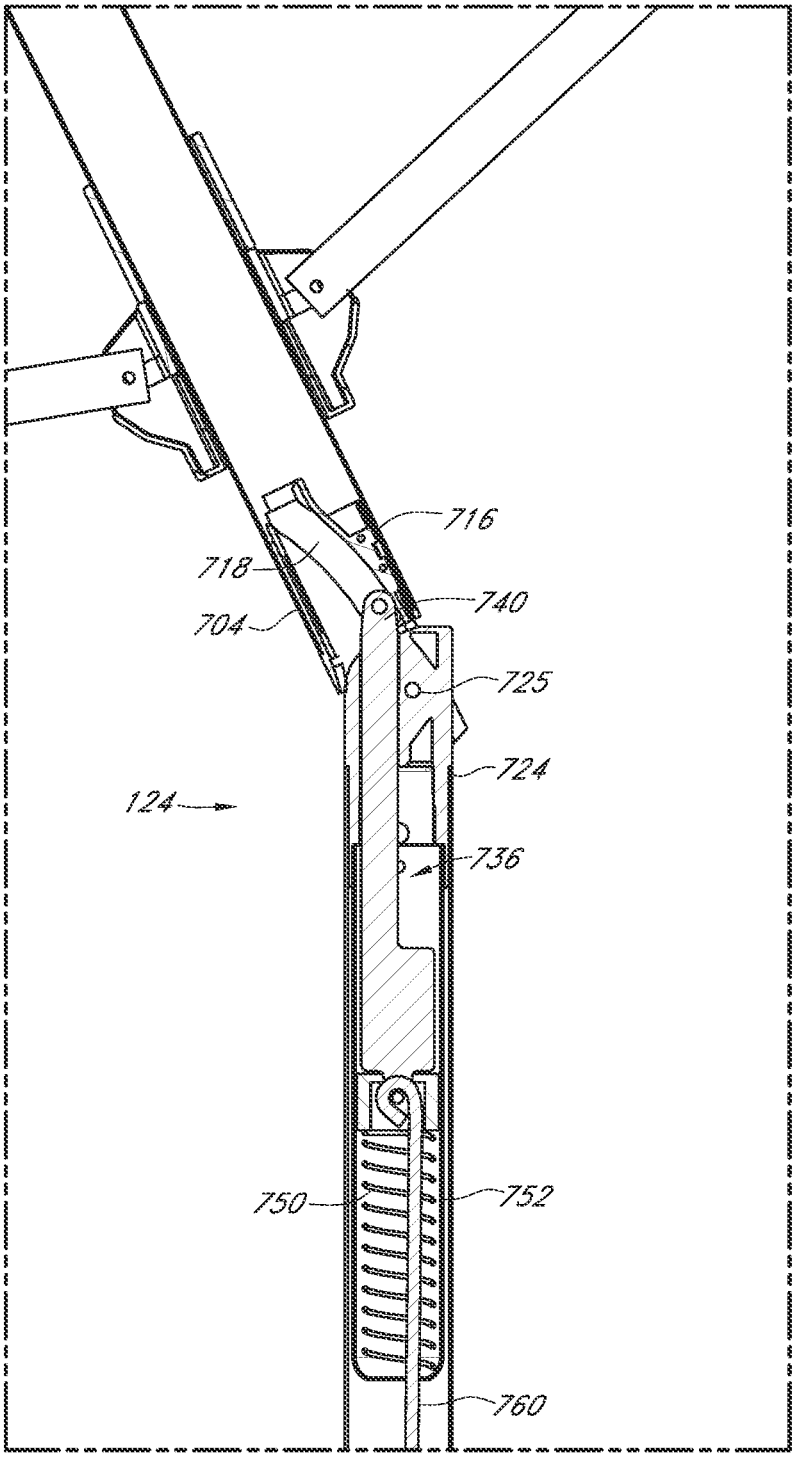
FIG. 7F shows a cross section of the tilt mechanism of FIG. 7A in a tilted configuration.

The tilt mechanism 124 can have a first configuration, which can be an untilted configuration as shown in FIGS. 1A and 7E or a first tilted angle. The tilt mechanism 124 can have a second configuration which can be tilted relative to the first configuration, as shown in FIGS. 1B and 7F. In the tilted configuration, the upper and lower pole portions 128, 132 can form an angle therebetween. The angle can have an apex at the pivot of the tilt mechanism 124. The first and the second configurations can both be tilted configurations, with the second configuration being more tilted than the first configuration. The tilt mechanism 124 can adjust between the first and second tilted configurations.

The tilt mechanism 124 can be controlled by an actuator 140. The actuator 140 can have an independent and/or separate control mechanism from the open/close mechanism 136. The actuator 140 can be operable by a person to selectively manipulate the tilt mechanism 124 between the first and second configurations. The actuator 140 provide a dedicated control for the tilt configuration of the umbrella 100, being part of a mechanism that is not functionally combined with the opening and closing mechanism 136. A control rod or cord (not shown) can couple the actuator 140 with the tilt mechanism 124. A first end of the control rod or cord can be coupled with the actuator 140. A second end of the control rod or cord can be coupled with the tilt mechanism 124.

II. Example Tilt Mechanism and Actuators

This application discloses and claims a variety of tilt mechanisms and actuators that are integrated into the umbrella 100 in different but advantageous manners. In some cases, the tilt mechanisms include actuators that are mounted in housings that surround the pole 120. The housings can be rotationally symmetric and in some cases are extensions of or from a housing of the opening and closing mechanism. The housings of the tilt mechanisms can be slideable along the pole 120. The mechanisms can be rotatable about a central longitudinal axis of the pole 120. The actuators can include or be coupled with rigid poles or cords that adjust the tilt configuration of the umbrella 100. The actuators can include or be coupled with tension members that adjust the tilt configuration of the umbrella 100.

A. Grip Actuated Tilt Mechanisms

FIGS. 2A-3B illustrate various actuator and tilt mechanism configurations in which a housing or grip portion of the actuator is moveable relative to the pole 120 to cause the actuator to move the tilt mechanism 124 to a tilted or a more tilted configuration. The engagement of the actuator with a fixed component of the umbrella 100 can enable the tilt mechanism 124 to remain in the tilted or more tilted configuration. The actuator can be disengaged from the fixed component by movement of the housing or grip and/or by depressing a button or similar component of the actuator.

1. Dedicated Push Button Grip Actuators For Tilt Adjustment

FIGS. 2A-3B illustrate an embodiment of an actuator 240 and an open/close mechanism 236, respectively. The actuator 240 is similar to the actuator 140 except as described differently below. The open/close mechanism 236 is similar to the open/close mechanism 136 except as described differently below. Features of the actuator 240 and the open/close mechanism 236 that are compatible with the actuator 140 and the open/close mechanism 136 can supplement the disclosures thereof.

The actuator 240 can include an outer sleeve 212. The outer sleeve 212 can be configured as a grip for handling by a user. The actuator 240 is disposed generally above the open/close mechanism 236 with some overlap at a lower portion of the sleeve 212. The degree of overlap can be larger or smaller depending on the tilt configuration of the umbrella to which the mechanism 236 and the actuator 240 are applied. The actuator 240 could be disposed generally below the open/close mechanism 236 in some variations, e.g., with some variable overlap therebetween. The outer sleeve 212 can be mounted on the central pole 120. The outer sleeve 212 can include a button 216.

The open/close mechanism 236 can include a housing 208. The housing 208 can be mounted on the central pole 120. The housing 208 can include an upper opening 209. A lower end of the sleeve 212 can be received within the opening 209. The open/close mechanism 236 can include a spool 205. The spool 205 can be mounted inside of the housing 208. The spool 205 can be coupled with the crank 204 in a manner that the spool 205 can be rotated along with the crank 204. The spool 205 can be coupled with the cord (not shown) for opening and closing the canopy of the umbrella 100.

The sleeve 212 can include a lower lip 211. The lower lip 211 can be disposed within the opening 209 of the housing 208. A lower portion of the sleeve 212 including the lower lip 211 can fit within the housing 208. The lower lip 211 can abut an inside surface of the housing 208 adjacent to the opening 209. The sleeve 212 can move relative to the housing 208 such that the lower lip 211 can be moved away from the opening 209. After being moved away from the opening 209, the lower lip 211 can be brought back to a position adjacent to the opening. The lower lip 211 can abut the inside surface of the housing 208 when disposed adjacent to the opening 209 to prevent the sleeve 212 from moving entirely out of the opening 209. A lower portion of the sleeve 212 is retained in the housing 208 in all positions of the sleeve 212 relative to the pole 120. The lower lip 211 can define in combination with the inside surface of the housing 208 one extent of the movement of the sleeve 212.

The actuator 240 can be coupled with a control rod 220. The control rod 220 can couple with the sleeve 212 by an interior connection portion, e,g. a pin 221. The control rod 220 can provide a connection between the tilt mechanism 124 and the actuator 240. The control rod can transmit both tension and compressive forces. Alternatively throughout the embodiment in this application, a control rod can be substituted for a cord. The cord can transmit a tension force to the tilt mechanism 124 from the actuator. The generic term for both a cord and a control rod can be a tension member.

The actuator 240 can include an engagement member, e,g. a hook member 224. The hook member 224 can include a hook end 223. The hook member 224 can include a button end 225. The button end 225 of the hook member 224 can be opposite the hook end 223. The button 216 can be the button end 225, or can be engaged therewith. The hook member 224 can be pivotable about a fulcrum 227. The fulcrum 227 can be fixed within the sleeve 212. The button end 225 and/or the button 216 can be biased by a spring 226. The spring 226 can bias the hook member 224 into a position to couple with a catch 230. The hook member 224 is oriented in the sleeve 212 such that the hook end 223 is at a lower elevation than the button end 225. Other orientations are also possible, including having the hook end 223 at a higher elevation than the button end 225 or having these portions at the same elevation.

Figure 2A:
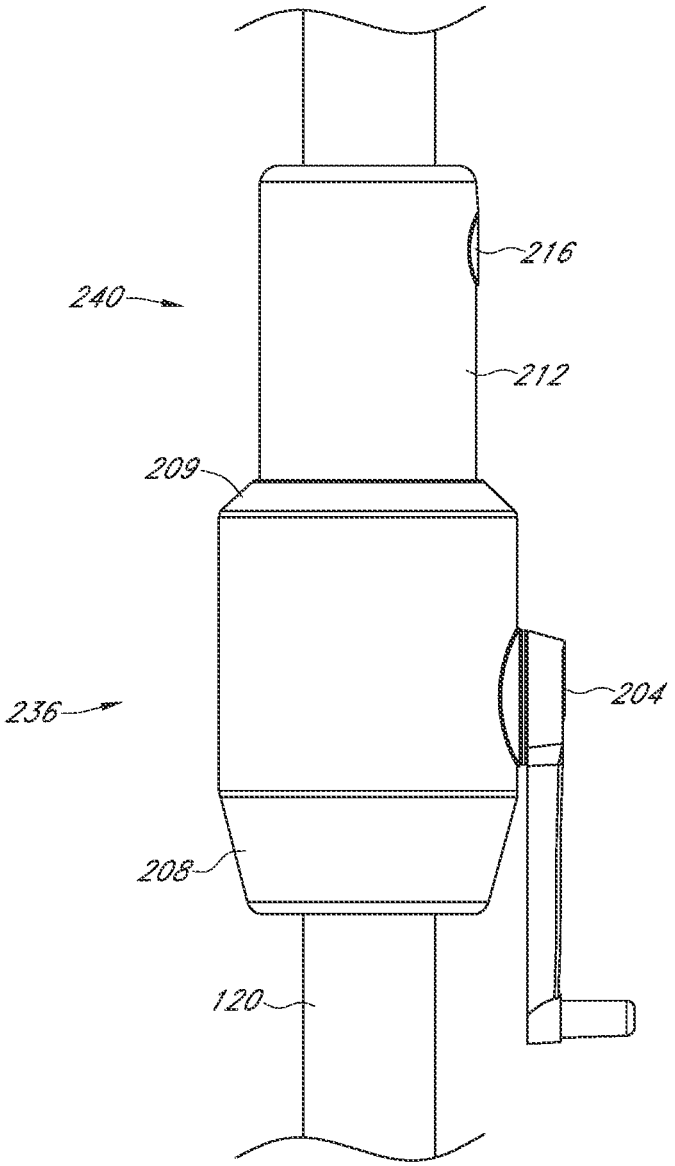
FIG. 2A shows an embodiment of the actuator of the umbrella of FIGS. 1A and 1B.
Figure 2B:
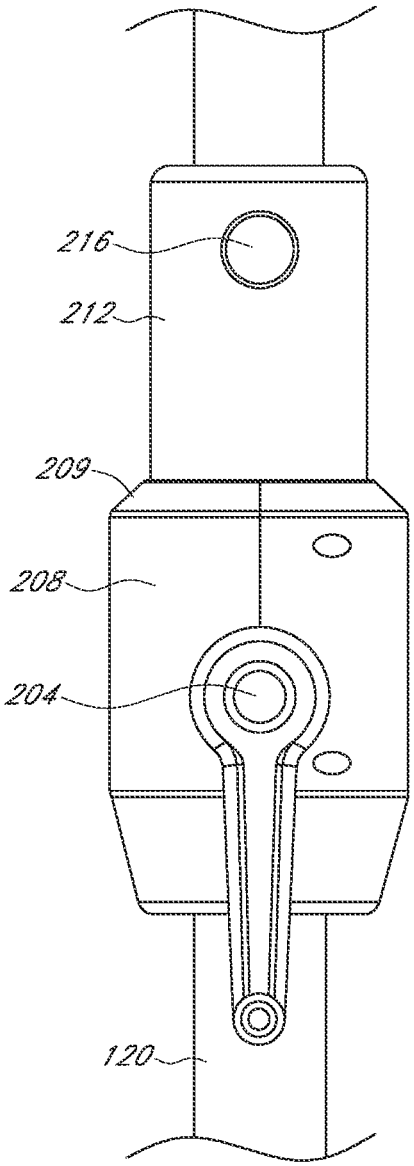
FIG. 2B shows the actuator of FIG. 2A in a side view.
Figure 2C:
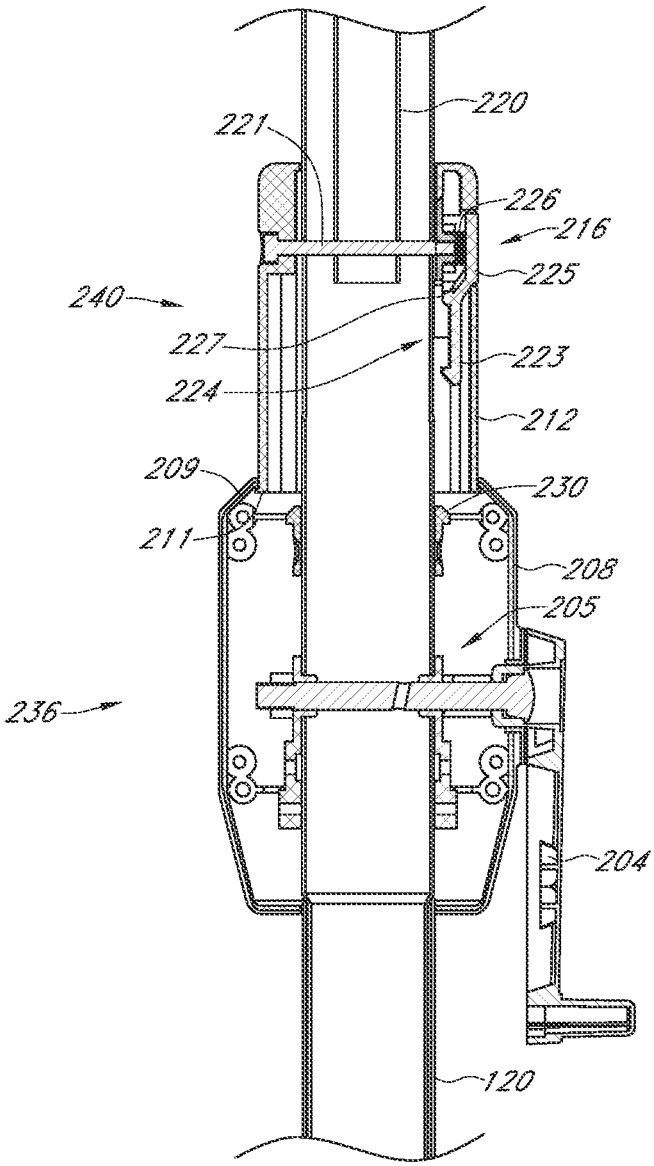
FIG. 2C shows a cross section of the actuator of FIG. 2A in a raised position.
Figure 2D:
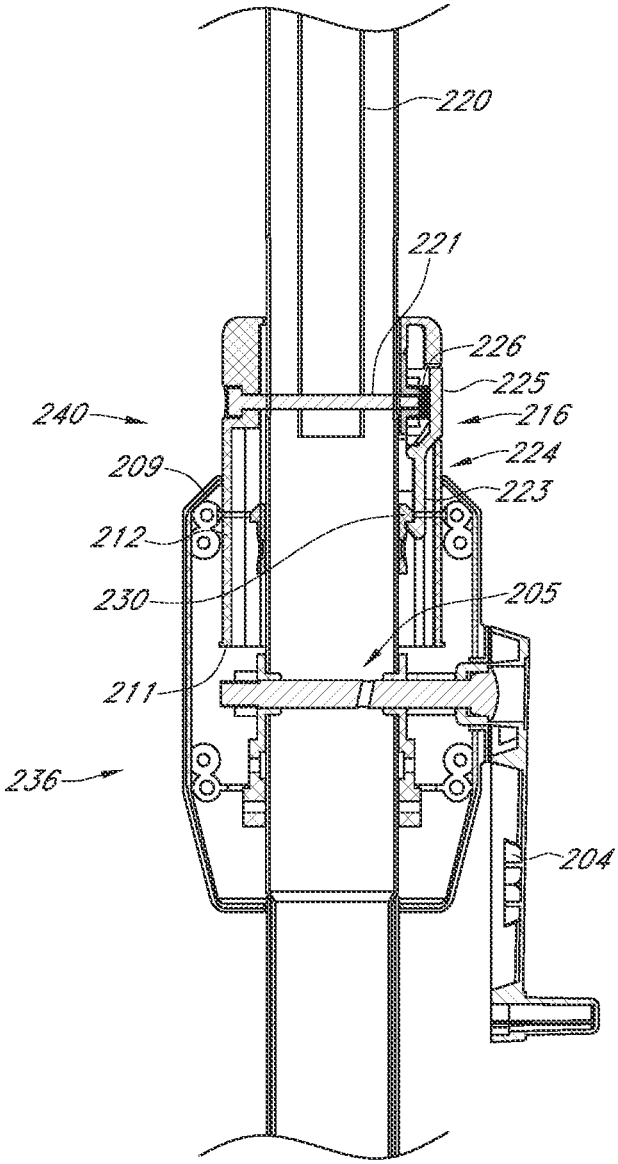
FIG. 2D shows a cross section of the actuator of FIG. 2A in a lowered position.

In use, the actuator 240 can have a raised position (FIG. 2A) and a lowered position (FIG. 2D). The raised position of the actuator 240 can correspond to the second configuration of the tilt mechanism 124. The raised position of the actuator 240 can correspond to an untilted or relatively less tilted configuration of the tilt mechanism 124. The raised position of the sleeve 212 can correspond to the first configuration of the tilt mechanism 124. The lowered position of the actuator 240 can correspond to a tilted or relatively more tilted configuration of the tilt mechanism 124. The movement of the sleeve 212 coupled with the control rod 220 can actuate the tilt mechanism.

In the lowered position, the sleeve 212 can be in a lower position along the central pole 120 relative to the position of the sleeve 212 in the raised position. The catch 230 can engage with the hook end 223 of the hook member 224 to maintain the sleeve 212 in the lowered position. In the lowered position, the hook end 223 can engage with the catch 230. The hook member 224 can be released from the catch 230 by pressing on the button 216. The button 216 can pivot the hook end 223 of the hook member 224 about the fulcrum 227 to release the hook end 223 from the catch 230. FIGS. 2A-2C illustrate a raised position of the actuator 240. FIG. 2D shows a lowered position of the actuator 240.

With the actuator 240, a user can easily manipulate the tilting mechanism 124 by alternately moving the sleeve 212 between the raised and lowered positions. This movement can include selectively releasing the sleeve 212 from the lowered position by pressing the button 216 to actuate the hook member 224. The sleeve 212 can have a rotationally symmetric configuration about a longitudinal axis of the pole 120. The sleeve 212 can have an arcuate, e.g., a circular, oval or elliptical outer periphery in a cross-section disposed transverse to the longitudinal axis of the pole 120. The sleeve 212 can have one or more flat edges, e.g., having a square, pentagon, octagon or other polygonal shape, in the outer periphery thereof in a cross-section disposed transverse to the longitudinal axis of the pole 120. The sleeve 212 can be configured as a grip for enhanced user handling, e.g., including a contour for the hand or fingers or having flutes, scallops or other features for improving grip for the movements described above.

2. Dedicated Fully Enclosed Grip Actuators For Tilt Adjustment

Figure 3A:
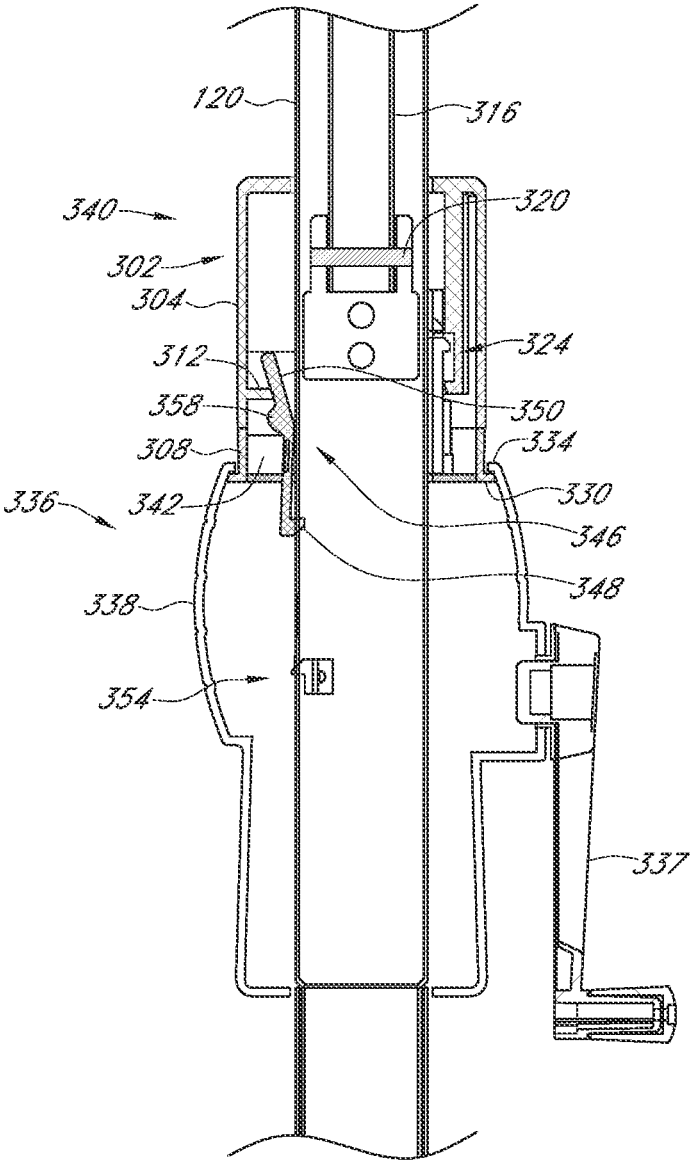
FIG. 3A shows a cross section of an embodiment of the actuator of the umbrella of FIGS. 1A and 1B in a raised position.
Figure 3B:
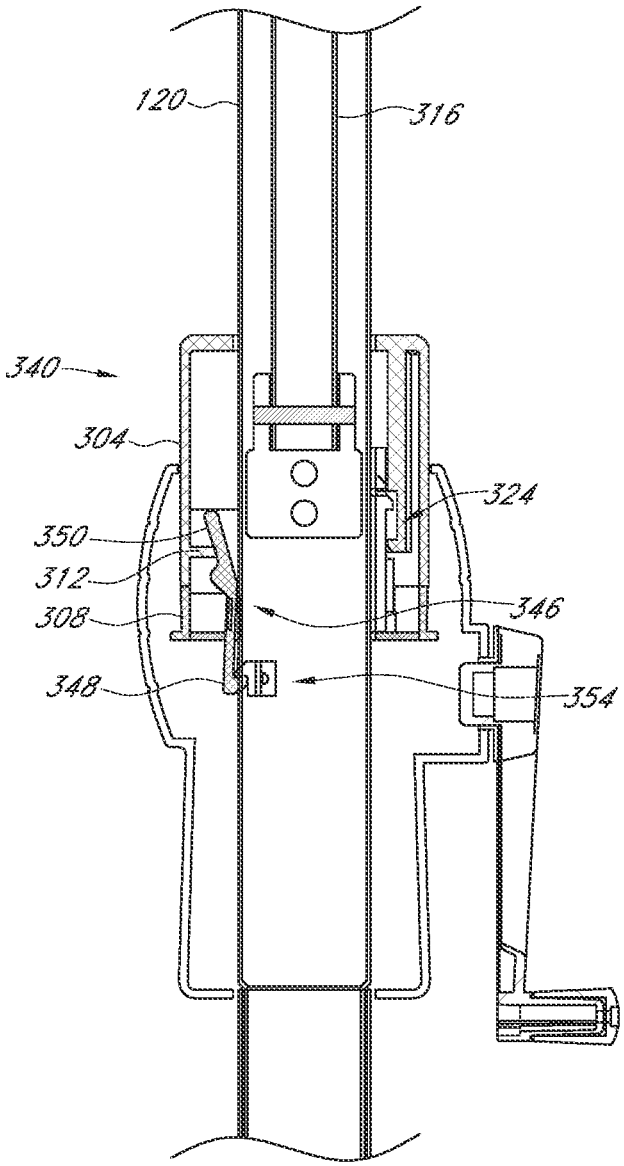
FIG. 3B shows a cross section of the actuator of FIG. 3A in a lowered position.

FIGS. 3A-3B illustrate an actuator 340 and an open/close mechanism 336 that are similar to the actuator 240 and open/close mechanism 236 discussed except as described differently below. The descriptions of the actuators 140, 240 and open/close mechanism 136, 236 that are not incompatible with the actuator 340 and the open/close mechanism 336 are considered to supplement the descriptions of the actuator 340 and the open/close mechanism 336. The descriptions of the actuators 340 and open/close mechanism 336 that are not incompatible with the actuator 140, 240 and the open/close mechanism 136, 236 are considered to supplement the descriptions of the actuator 140, 240 and the open/close mechanism 136, 236.

The open/close mechanism 336 can include a housing 338. The housing 338 can be mounted on the central pole 120. The housing 338 is a slideable housing that is configured to operated by a force applied by a user's hand and can be referred to herein as a grip. The open/close mechanism 336 can include a crank 337 for rotating a spool (not shown) for opening and closing the canopy assembly of the umbrella 100. The housing 338 can include an upper opening 334. The housing 338 can otherwise include no other openings or push button for manipulating the actuator 340, in at least some embodiments.

The actuator 340 can include a sleeve 302. The sleeve 302 can be mounted on the central pole 120. The sleeve 302 can include a top portion 304. The sleeve 302 can include a bottom portion 308. The top and bottom portions 304, 308 can be coupled together by a sliding catch 324. The sliding catch 324 can enable a range of relative movement in a linear direction between the top portion 304 and the bottom portion 308. The sliding catch 324 can include one or more hooks or projections providing engagement at the end of the linear movement between the top and bottom portions 304, 308. The bottom portion 308 can be received within the opening 334. The bottom portion 308 can include a lip 330 for engagement with an inner side of the housing 338 at the opening 334. The sleeve 302 can be coupled with a control rod 316. The control rod 316 can be coupled with the tilt mechanism 124. The control rod 316 can be located within the central pole 120. An interior connection portion, e,g. a pin 320 can couple the sleeve 302 and the control rod 316.

The top portion 304 of the sleeve 302 can include an inner radial protrusion 312. The bottom portion 308 of the sleeve 302 can include an engagement member, e.g., a hook member 346. The hook member 346 can be attached at a fulcrum 358 with the bottom portion 308. The hook 346 can include an angled portion 350 and a hook portion 348. The bottom portion 308 can include a spring 342. The spring 342 can bias a position of the hook member 346. The spring 342 can bias the hook end 348 against the central pole 120. The angled portion 350 of the hook member 346 can be angled away from the central pole 120. A catch 354 can be located on the central pole 120 or elsewhere within the housing 338. The catch 354 can engage with the hook end 348 of the hook 346.

The actuator 340 can have a raised position. The raised position can correspond to the first configuration of the tilt mechanism 124. The actuator 340 can have a lowered position. The lowered position can correspond to the second configuration of the tilt mechanism 124. In the raised position, the sleeve 302 is higher than the position of the sleeve 302 in the lowered position. The lowered position can be achieved by a user pushing the sleeve 302 downward along a longitudinal axis of the central pole 120. In the lowered position, the hook member 346 can engage with the catch 354, as shown in FIG. 3B. The spring 342 can bias the hook end 348 into engagement with the catch 354.

The sleeve 302 can be raised into the raised position by pulling the upper portion 304 of the sleeve 302 in an upward direction along the longitudinal axis of the central pole 120. The upper portion 304 can slide with respect to the lower portion 308 through the sliding catch 324. The lower portion 308 can be coupled with the catch 354 by the hook member 346. The inner radial protrusion 312 can engage with the angled portion 350 of the hook member 346. The inner radial protrusion 312 can provide an inward radial force on the angled portion 350 to rotate the hook member 346 about the fulcrum 358. Rotation of the hook 346 can disengage the hook end 348 from the catch 354. This can enable the sleeve 302 to be raised into the raised position. The inward radial force of the inner radial protrusion 312 can be applied as the upper portion 304 of the sleeve 302 is pulled in an upward direction along the longitudinal axis of the central pole 120 and the lower portion 308 is immovable in this direction because it is coupled with the catch 354 by the hook member 346. The inward radial force of the inner radial protrusion 312 can actuate the hook member 346 to release the lower portion 308 from the catch 354.

In some implementations, the sliding catch 324 can be replaced or used in addition to a rotatable connection between the upper and lower portion 304, 308. The upper portion 304 can be rotatable relative to the lower portion 308. The inner radial protrusion 312 can have a varying diameter around the sleeve 302. Rotation of the upper portion 304 relative to the lower portion 308 can change point of interface with the angled portion 350 with the inner radial protrusion 312. The inner radial protrusion 312 can change radial position relative to the central pole 120 such that rotation in one direction engages the angled portion 350 (e.g., by moving inwardly towards the central pole 120) and rotation in the opposite direction disengages the angled portion 350 (e.g., by moving outwardly from the central pole 120). In one embodiment, the inner radial protrusion 312 extends circumferentially (e.g., into the page in FIG. 3A). The radial extent of the protrusion 312 is greater in a direction into the page such that counter-clockwise rotation (as viewed from above) of the top portion 304 of the sleeve 302 causes the portion of the protrusion 312 with greater radial extent to apply a load on the angled portion 350 rotating the hook member 346.

B. Side Actuated Tilt Mechanisms

In some embodiments, an actuator is provided on one side of the pole 120 of the umbrella 100. The side actuator provides the advantage that movement between more and less tilted configurations can be controlled by an actuator disposed on one side of the pole 120, e.g., without requiring gripping around the longitudinal axis of the pole. Another advantage includes that the side actuator can include an actuation member that a user can grasp that provides greater leverage. The actuation member can be sized to easily fit within a user's hand. The actuation member can include one or more grip-enhancing features, such as those described above. The leverage achievable with the side actuator requires less force to actuate the tilt mechanism 124 and/or can be actuated with greater ease or accuracy by a user.

1. Side Access Pull Down Actuator

FIGS. 4A-4D illustrate an actuator 440 and an open/close mechanism 436, respectively. The open/close mechanism 436 can include a housing 408 and a crank handle 412. The actuator 440 can be located above or below the open/close mechanism 436 along the central pole 120. The actuator 440 can include a housing 420 attached with the central pole 120. The housing can include a channel 405. The actuator 440 can include a driver knob 404. The driver knob 404 can slide within the channel 405. The driver knob 404 can slide in a linear direction. The linear direction can be parallel to the longitudinal axis of the central pole 120. The driver knob 404 can couple with a latch 424. The latch 424 can be located at a lower end of the channel 405.

The driver knob 404 can be coupled with a drive rod 418. The drive rod 418 can attach with the tilt mechanism 124. A lower end of the drive rod 418 can be coupled with the driver knob 404. The lower end of the drive rod 418 can be coupled at a pivot location 416 of the driver knob 404.

The driver knob 404 can include a sliding pin 432. The sliding pin 432 can move in a linear direction. The linear direction can be in a direction transverse to the longitudinal axis of the central pole 120. The sliding pin 432 can be biased towards the central pole 120 by a spring 428. The sliding pin 432 can include a slot therein. The sliding pin 432 can include an angled end surface. The housing 420 can include a catch 424. The catch 424 can be fixed with the housing 420. The catch 424 can be fixed relative to the central pole 120.

The actuator 440 can have a raised position. The raised position can correspond to the first configuration of the tilt mechanism 124. The actuator 440 can have a lowered position. The lowered position can correspond to the second configuration of the tilt mechanism 124. In the raised position, the driver knob 404 is higher than the position of the driver knob 404 in the lowered position.

Figure 4A:
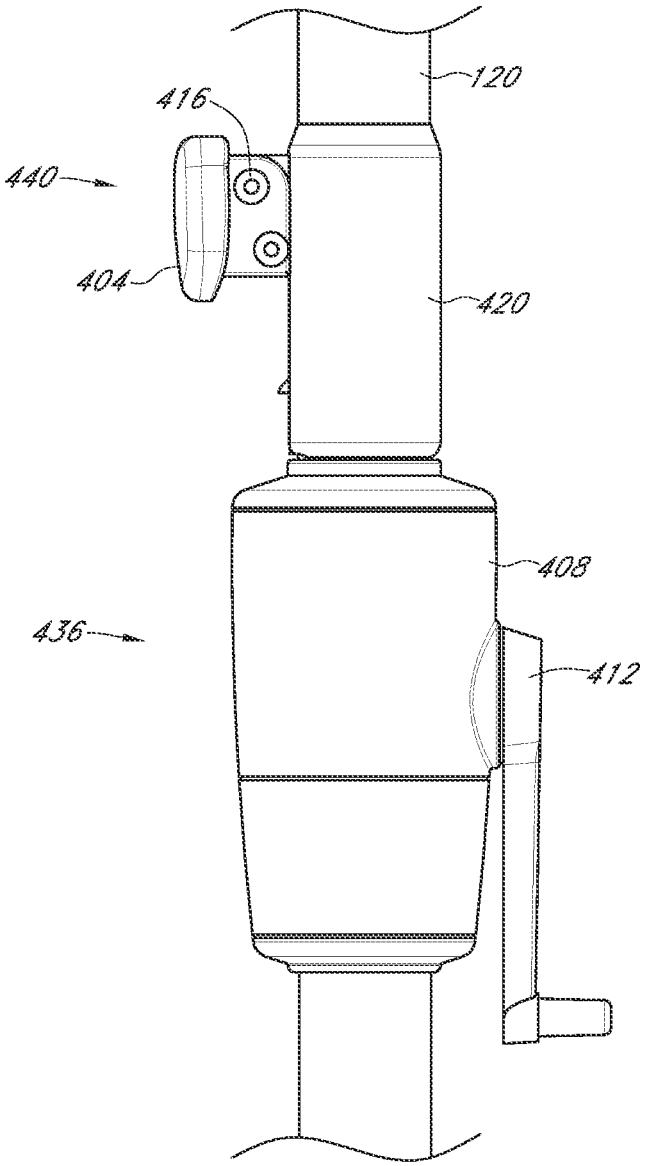
FIG. 4A shows an embodiment of the actuator of the umbrella of FIGS. 1A and 1B.
Figure 4B:
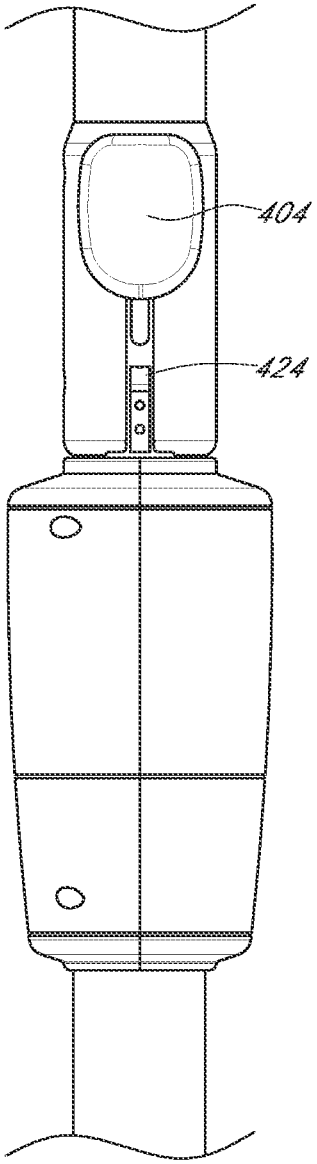
FIG. 4B shows the actuator of FIG. 4A in a side view.
Figure 4C:
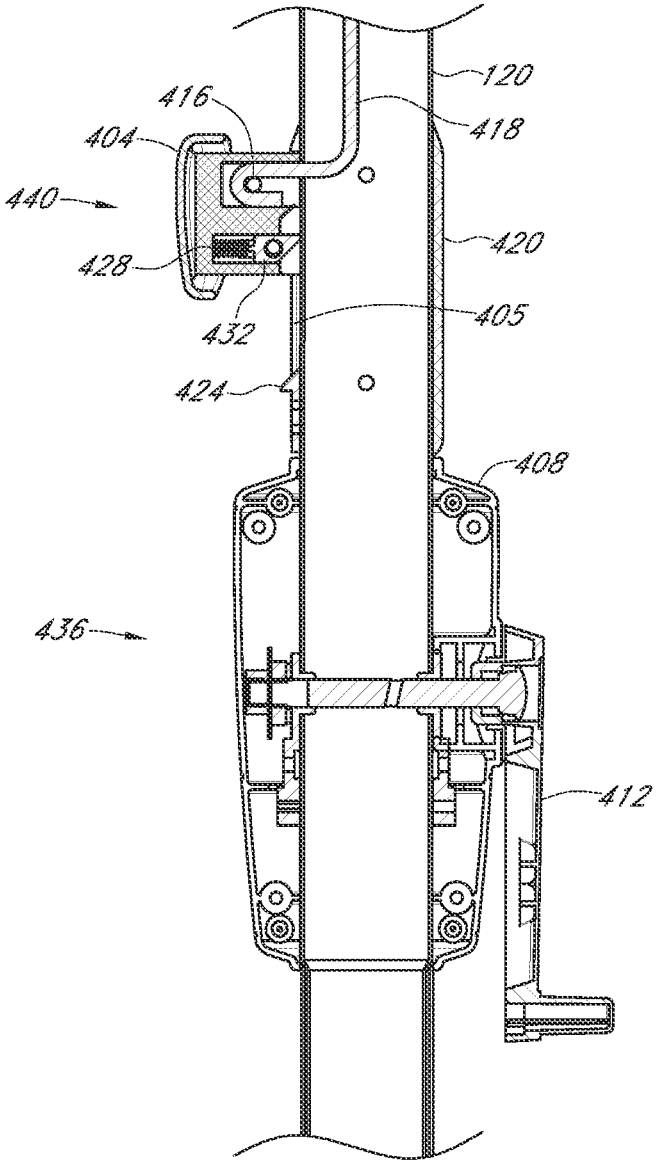
FIG. 4C shows a cross section of the actuator of FIG. 4A in a raised position.
Figure 4D:
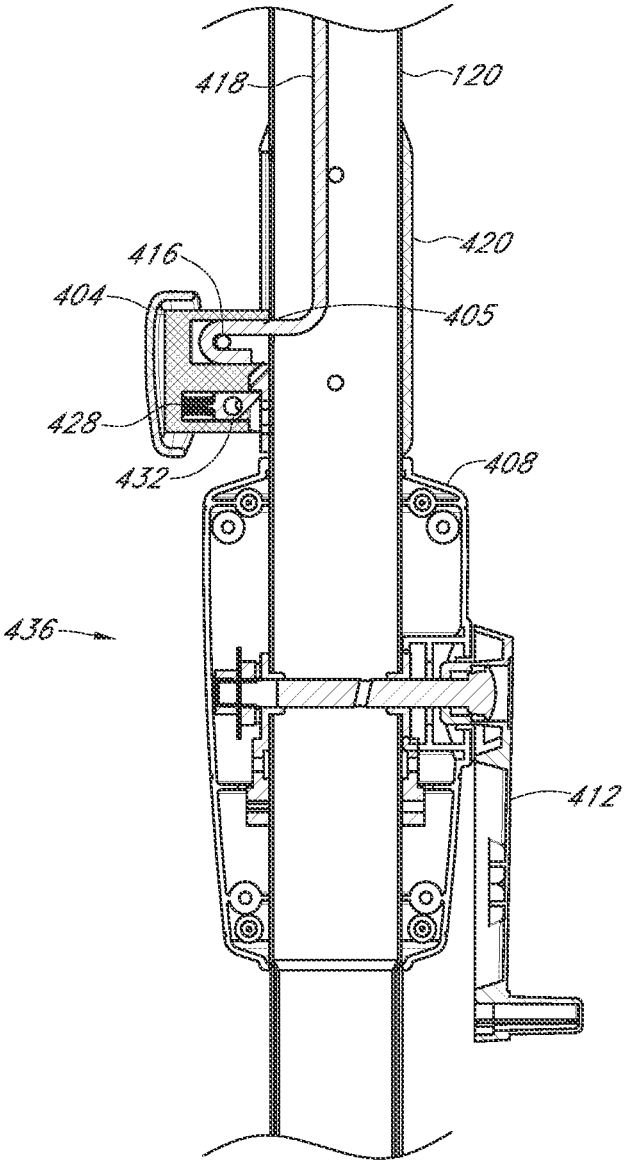
FIG. 4D shows a cross section of the actuator of FIG. 4A in a lowered position.

The lowered position can be achieved by a user pushing the driver knob 404 downward along the channel 405. In the lowered position, the driver knob 404 can engage with the catch 424, as shown in FIG. 4D. The spring 428 can bias the sliding pin 432 into engagement with the catch 424. The driver knob 404 can be released from the lowered position by releasing the sliding pin 432 from the catch 424. The sliding pin 432 can be released from the catch 424 by rotating the driver knob 404 outward on the pivot 416 to disengage the sliding pin 432 from the catch 424.

2. Side Access Rotatable Linkage Actuator

The actuator 140 can take the form of an actuator 540 as illustrated in FIGS. 5A-5D. The actuator 540 can be located above a open/close mechanism 536. The open/close mechanism 536 can include housing and a crank handle 516.

FIGS. 5A-5D illustrate an embodiment of the actuator 140 and the open/close mechanism 136 as an actuator 540 and an open/close mechanism 536, respectively. The actuator 540 can be located on the central pole 120. The actuator 540 can be located directly above or below a housing 512 of the open/close mechanism 536. The open/close mechanism 536 can include a handle 516.

The actuator 540 can include a pivot handle 508. The pivot handle 508 can engage with a positioning surface 504. The positioning surface 504 can extend in a transverse direction from the central pole 120. The positioning surface 504 can be semi-circular in shape. The positioning surface 504 can include one or a plurality of tilt position features, e.g., teeth 520. The teeth 520 can be spaced along a circumference of the positioning surface 504. The positioning surface 504 can be a ratchet. The positioning surface 504 can include first and second plate members 504*a*, 504*b*. The first and second plate members 504*a*, 504*b* can be identical. The first and second plate members 504*a*, 504*b* can extend outwardly from the central pole 120. The pivot handle 508 can be disposed between the first and second plate members 504*a*, 504*b*.

Figure 5A:
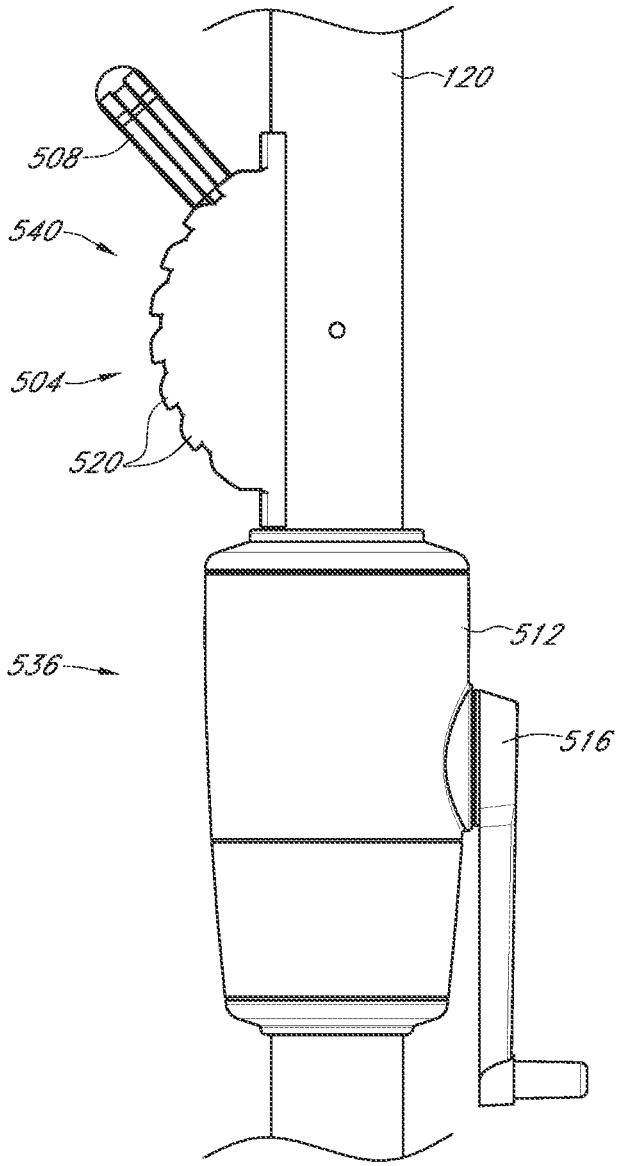
FIG. 5A shows an embodiment of the actuator of the umbrella of FIGS. 1A and 1B.
Figure 5B:
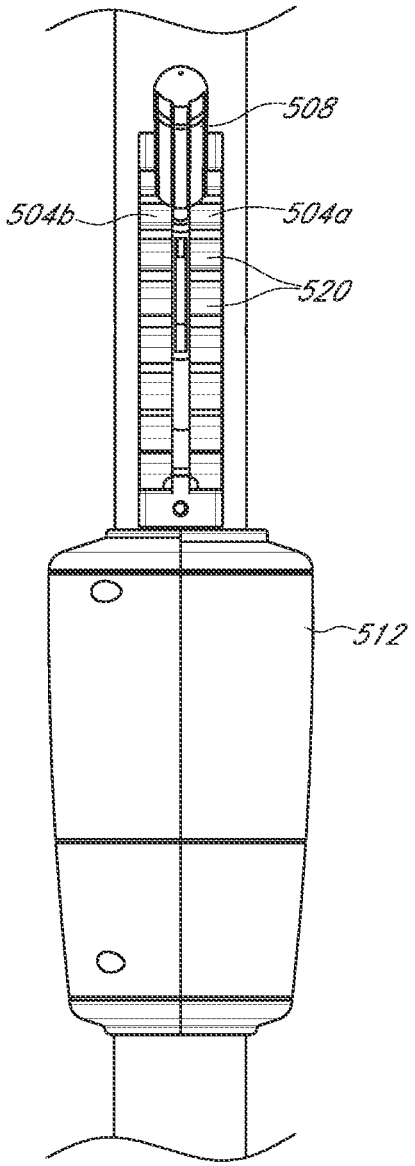
FIG. 5B shows the actuator of FIG. 5A in a side view.
Figure 5C:
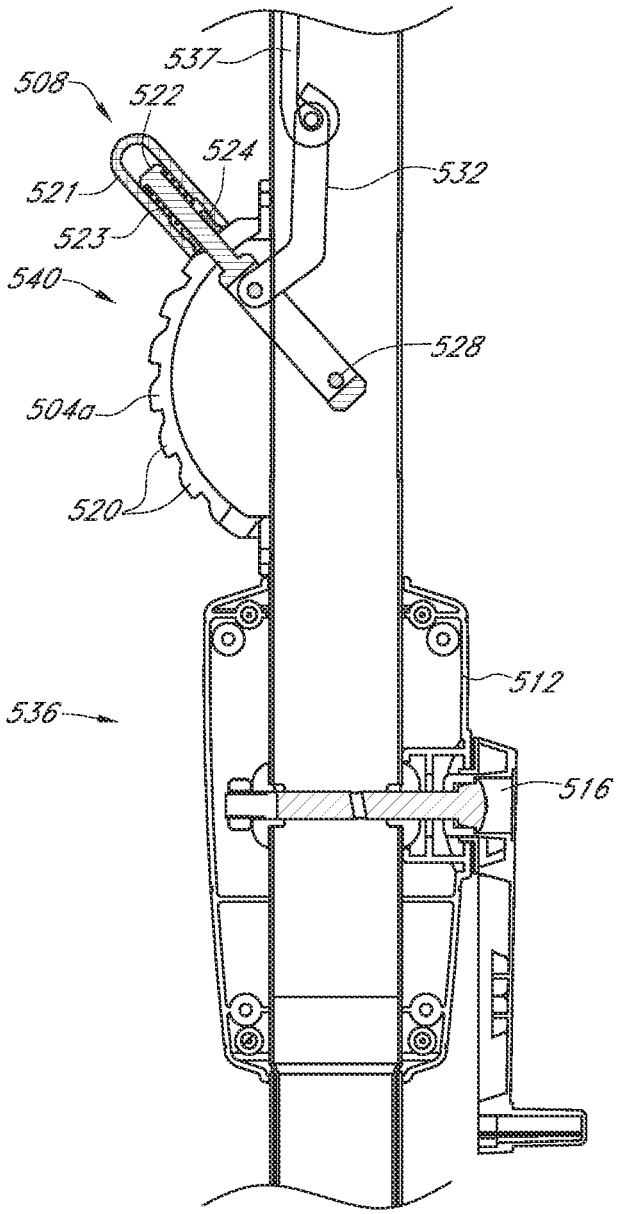
FIG. 5C shows a cross section of the actuator of FIG. 5A in a raised position.

The pivot handle 508 can pivot at a pivot location 528. The pivot location 528 can be located on an outer surface or within the central pole 120. The pivot handle 508 can be coupled with a cord 537. The cord 537 can be coupled with the pivot handle 508 through an elbow 532. The elbow 532 is one example of a link that can be provided in the pivot handle 508. The link can be pivotable relative to a free end of the pivot handle 508. FIG. 5C shows that the pivotable link can have first and second ends that are angled to one another. In one embodiment one of the ends is pivotably connected to the pivot handle 508. Alternatively, the cord 537 can be a control rod.

Figure 5D:
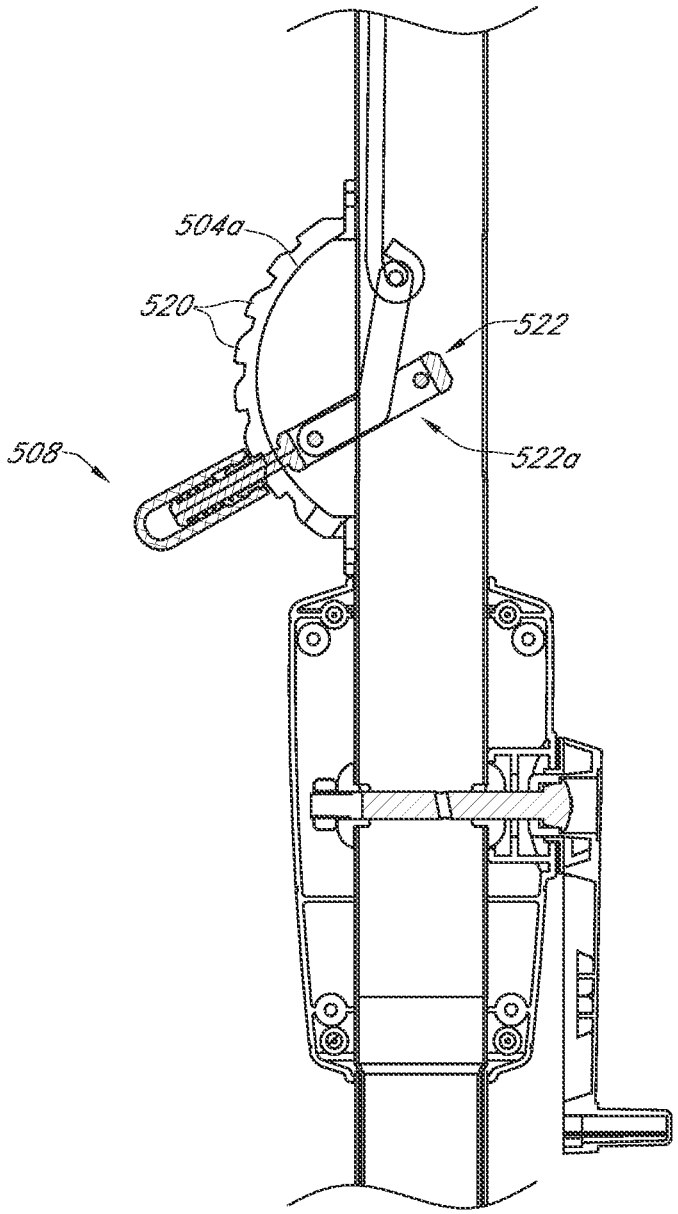
FIG. 5D shows a cross section of the actuator of FIG. 5A in a lowered position.

FIG. 5D shows that the end coupled to the pivot handle can pivot into alignment with the pivot handle in an un- or less tilted configuration and can pivot out of alignment with the pivot handle 508 in a tilted or more tilted configuration. The pivot handle 508 can include a grip portion 521. The grip portion 521 can be coupled with an engagement member 524. The engagement member 524 can engage with the teeth 520 of the positioning surface 504. The engagement member 524 can maintain a position of the pivot handle 508. The pivot handle 508 can include a core rod 522. The core rod 522 can extend from the grip portion 521 to the pivot location 528. The pivot handle 508 can include a spring 523. The spring 523 can bias the engagement member 524 and/or the grip 521 into engagement with the teeth 520 of the positioning surface 504. The cord 537 can be coupled with the core rod 522 by the elbow 532. The core rod 522 can include a forked portion 522*a*. The forked portion 522*a* can couple with the pole 120 at the pivot location 128. The elbow 532 can be received between forks of the forked portion 522*a* in the lowered position, as shown in FIG. 5D.

The pivot handle 508 can have a raised position, as shown in FIG. 5C. In the raised position, the pivot handle 508 is at an angled position that allows the control rod 538 to be in a raised position. The cord 537 can engage with the tilt mechanism 124. The raised position of the pivot handle 508 can correspond to the untilted position of the tilt mechanism 124. The pivot handle 508 can be engaged with or not engage with the teeth 520 of the positioning surface 504 in the raised position.

FIG. 5D illustrates the pivot handle 508 in a lowered position. The lowered position can be located along the positioning surface 504. In the lowered position, the engagement member 524 can be engaged with one or more of the plurality of teeth 520. Engagement between the engagement member 524 and the teeth 520 can maintain the lowered position of the pivot handle 508. The lowered position of the pivot handle 508 can apply a force through the cord 537 to the tilt mechanism 124. The lowered position of the pivot handle 508 can correspond to the second configuration of the tilt mechanism 124.

The pivot handle 508 can be released from the lowered position by pulling the grip portion 521 away from the positioning surface 504. This can pull the engagement member 524 out of engagement with the teeth 520 and allow the pivot handle 508 to be rotated back into the raised position.

3. Side Access Rotatable Lever Actuator

FIGS. 6A-6D illustrate an actuator 640 and an open/close mechanism 636. The actuator 640 can be mounted on the central pole 120. The actuator 640 can be located directly above or below the open/close mechanism 636. The open/close mechanism 636 can include a housing 616 and a crank handle 620.

The actuator 640 can include a pivot handle 604. The pivot handle 604 can be pivotally coupled at a pivot location 608 with a housing 624. The pivot location 608 can be located within the pole 120, or at a periphery of the pole 120, or on the housing 624. A central portion of the pivot handle 604 can be pivotable in a slot of the housing 624.

The housing 624 can extend outwardly from the central pole 120. Optionally, the housing 624 can be coupled on an exterior circumference of the central pole 120. The pivot handle 604 can include one or more divots 612. The divots 612 can engage with one or more corresponding protrusions 614 on the housing 624. The housing 624 can include one, two or more protrusions formed on one or more surfaces bounding the slot. The divots 612 and the protrusions 614 can be included on corresponding sides of the pivot handle 604 and inner portions of the housing 624 facing the slot. In some implementations, the positions of the protrusions 614 and divots 612 can be reversed. Moreover, the protrusions 614 and divots 612 provide the advantage of requiring little or no manipulation of mechanisms by a user. The protrusions 614 and divots 612 can prevent a user having to twist a knob to secure a position of the pivot handle 604.

Figure 6A:
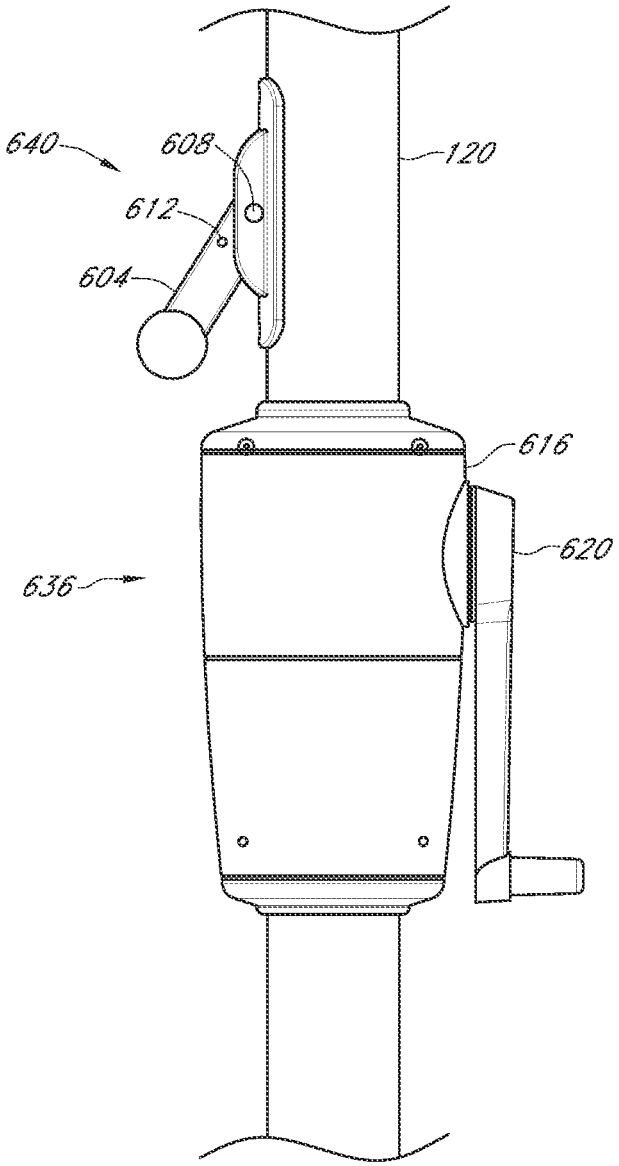
FIG. 6A shows an embodiment of the actuator of the umbrella of FIGS. 1A and 1B.
Figure 6B:
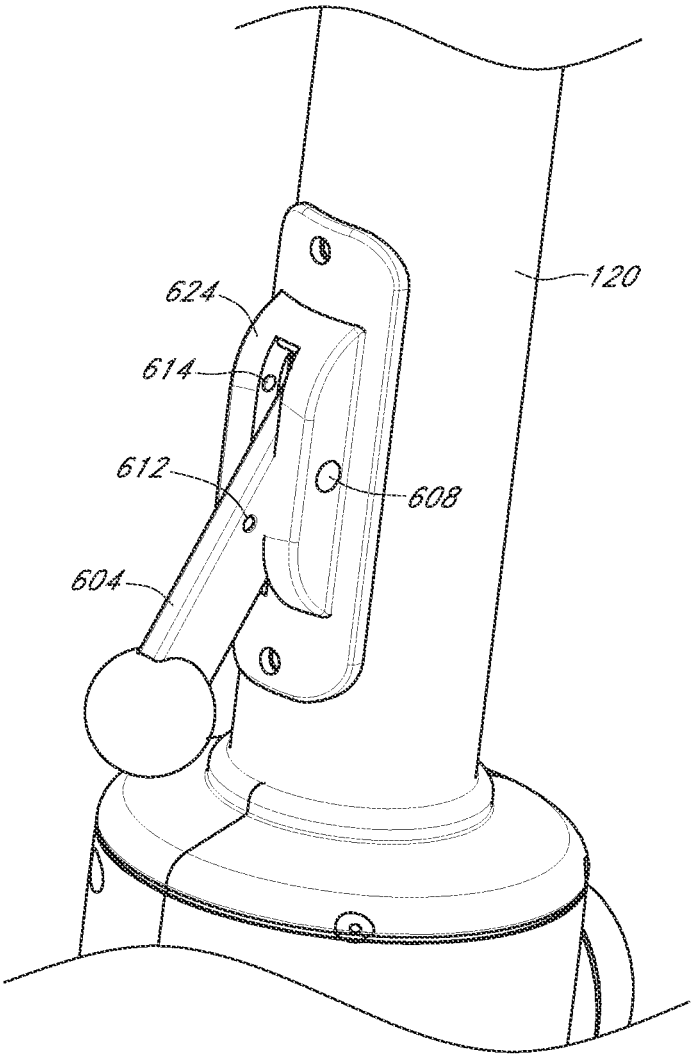
FIG. 6B shows the actuator of FIG. 6A in a side view.
Figure 6C:
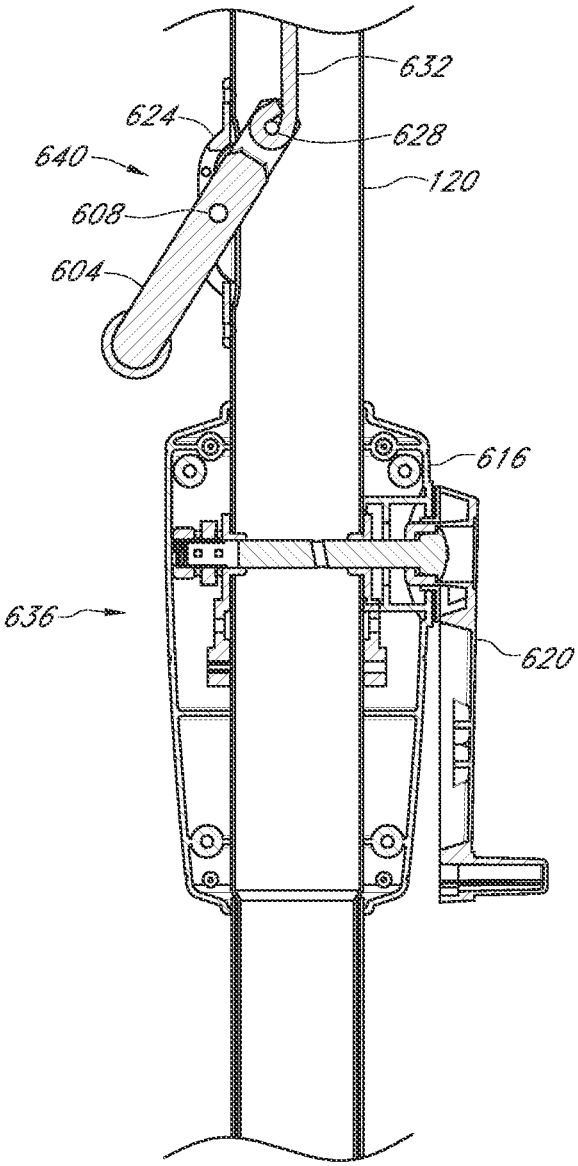
FIG. 6C shows a cross section of the actuator of FIG. 6A in a lowered position.

The pivot handle 604 can include an inner end 628. The pivot location 608 can be offset from inner end 628. This arrangement can provide the advantage of minimizing the size of an aperture through the periphery of the pole 120. The inner end 628 can be coupled with a cord 632. The cord 632 can be coupled with the tilt mechanism 124. As shown in FIG. 6C, the pivot handle 604 can include a lowered position. In the lowered position of the pivot handle 604, the inner end 628 can be raised. The raised inner end 628 can correspond to the untilted configuration of the tilt mechanism 124. Alternatively, the cord 632 can be a control rod. A first of the protrusions 614 can engage the divot 612 in the pivot handle 604 is in the lowered configuration.

Figure 6D:
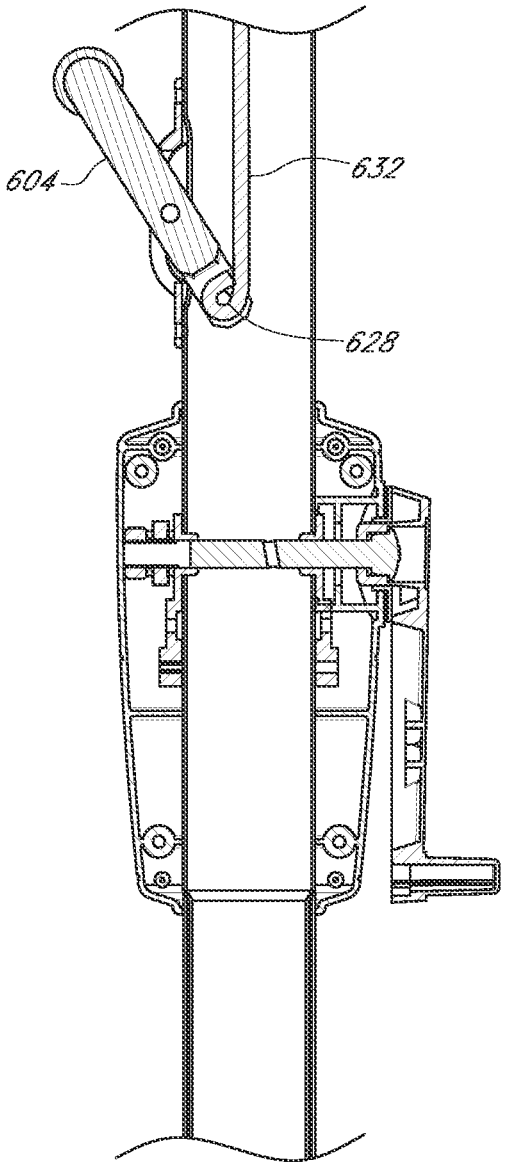
FIG. 6D shows a cross section of the actuator of FIG. 6A in a raised position.

The pivot handle 604 can be actuated into a raised position as shown in FIG. 6D. In the raised position of the pivot handle 604, the inner end 628 can be lowered. The lowered inner end 628 can transmit a force along the pivot cord 632. The cord 632 can actuate the pivot mechanism 124. The cord 632 can be a cord. The cord can provide the advantages of less cost to manufacture and/or less weight that must be moved by the actuator 640 (or any other actuator herein). The cord 632 can attach at an end of the pivot handle 604. This location can provide a desirable mechanical advantage. The central portion of the pivot handle 604 can be pivotable in the slot of the housing. At least two protrusions 614 can be formed on one or more surfaces bounding the slot. A second of the protrusions 614 can engage the divot 612 when the pivot handle 604 is in the raised configuration, the first protrusion 614 being disposed below the second protrusion 614.

The raised position of the pivot handle 604 can correspond to the tilted configuration of the tilt mechanism 124. The raised position of the pivot handle 604 can be held in place by interaction of the divots 612 with the protrusions 614. In some configurations, the protrusions 614 can be spring loaded to provide an engagement force with the divots 612 of the pivot handle 604. In some configurations, the housing 624 includes one or more apertures and a detent pin; the detent pin can extend through the housing 624 and the raised pivot handle 604.

III. Further Details of Tilt Mechanisms

FIGS. 7A-7F illustrate further detail of the tilt mechanism 124. The tilt mechanism 124 can comprise an upper coupler 704. The upper coupler 704 is attached with the upper pole portion 128 of the central pole 120. The tilt mechanism 124 can include a lower coupler 724. The lower coupler 724 is attached with the lower pole portion 132 of the central pole 120. The upper and lower couplers 704, 724 are pivotally coupled together at a pivot 725. The pivot 725 can include a pin coupled between one or more corresponding flanges of the upper and lower coupler members 704, 724. As show in FIGS. 7A and 7B, the tilt mechanism 124 is in the untilted configuration.

The tilt mechanism 124 can include the upper and/or lower couplers 704, 724. The upper coupler 704 can include a pole engagement portion 708. The pole engagement portion 708 can be sized to fit within the upper pole portion 128 of the central pole 120. The pole engagement portion 708 can enhance the strength of the connection between the upper coupler 704 and the upper pole portion 128. The upper coupler 704 can include a flange portion 712. The flange portion 712 can include the pivot location 725.

The lower coupler 724 can include a flange portion 728. The flange portion 728 can include the pivot location 725. The flange portion 728 is coupleable with the flange portion 712 of the upper coupler 704. The lower coupler 724 can include a shaft engagement portion 732. The shaft engagement portion 732 can be sized to fit within the lower pole portion 132 of the central pole 120.

The tilt mechanism 124 can include a driver 736. The driver 736 can include a channel engagement end 740. The channel engagement end 740 can fit within a slot (not shown) within the lower coupler 724. The channel engagement end 740 can optionally be coupled with one or more bearings 746. The driver 736 can include a coupler end 744.

The tilt mechanism 124 can include a stop member 748. The tilt mechanism 124 can include a spring 750. The tilt mechanism 124 can include a spring sleeve 752. The spring sleeve 752 can be sized to couple with the lower coupler 724. The spring 750 can be located within the spring sleeve 752. The stop 748 can be located within the spring sleeve 752 and engaged with the spring 750. The spring 750 can be compressed against a lower end of the spring sleeve 752. The stop 748 can engage with the coupler end 744 of the driver 736. The driver 736 can fit within the lower coupler 724.

The tilt mechanism 124 can include one or more channel members 716, 720. The channel member 716 and/or 720 can include a channel 718. The channel engagement end 740 of the driver 736 can fit through the lower coupler 724 and into the channel 718. The channel 718 can include a cam surface that has an offset, upper end 718*a*. The offset, upper end 718*a* can be offset in a radial direction relative to a central longitudinal axis of the umbrella central pole 120. The cam surface can include an offset, lower end 718*b*. The offset, lower end 718*b* can be offset in a different radial direction relative to a central longitudinal axis of the umbrella central pole 120.

The bearings 746 coupled with the channel engagement end 740 of the driver 736 can engage within the channel 718. The coupler end 744 of the driver 736 can engage with a cord or drive rod 760, as described above in each of the actuator embodiments (140-640).

The drive rod or cord 760 can extend through the spring sleeve 752 to couple with the coupler end 744 of the driver 736. In the first configuration of the tilt mechanism 124 shown in FIG. 7E, the spring 750 is extended. The spring 750 can apply a force that pushes the driver 736 into the channel 718 in a raised position. With the driver 736 in the raised position, the upper end or channel engagement end 740 can be at the upper end 718*a* of the channel 718. This position of the driver 736 can correspond to the first configuration of the tilt mechanism 124.

FIG. 7F illustrates the second configuration of the tilt mechanism 124. In the second configuration, the control rod 760 can exert a downward force on the driver 736. This moves the driver 736 downward and compresses the spring 750. The movement of the slider downward moves the channel engagement end 740 into the lower end 718*b* of the channel 718. This causes the channel engagement end 740 to engage with the cam surface of the channel 718. This engagement can cause the upper coupler 704 to rotate with respect to the lower coupler 724 about the pivot location 725. The amount of rotation or tilting can be dependent on the displacement or force applied through the control rod 760 (e.g., the position of the channel engagement end 740 in the channel 718). The spring 750 can bias the driver 736 into the raised position. Once the force on the drive rod or cord 760 from the actuator 140 is released, the spring 750 can expand to force the driver 736 into the raised position. This can return the umbrella 100 into the untilted configuration of the tilt mechanism 124. Alternatively, no spring is included.

In another embodiment of the umbrella 100, the tilt mechanism 124 is reversed. The upper and lower couplers 704, 724 are reversed and attached with the lower and upper pole portions, respectively. The driver 736 can be coupled with the cord 760. The cord 760 can be looped over a puller within the canopy assembly to reverse its orientation. The driver 736 can move upwards to align the lower couplers in the first configuration. The driver 736 can move downwards to the angle of the second configuration.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An umbrella, comprising:

an upright pole, the upright pole comprising an upper pole portion and a lower pole portion;

a canopy assembly comprising the upper pole portion;

a first mechanism for opening and closing the canopy assembly;

a second mechanism for adjusting an angle between the upper pole portion and the lower pole portion, the second mechanism comprising a driver having an end disposed in a channel of a channel member, the channel guiding the end of the driver disposed therein; and an actuator for the second mechanism, the actuator coupled with the lower pole portion and configured to adjust the second mechanism from a first configuration to a second configuration when a portion of the actuator directly actuated by a user is lowered from a raised position relative to a longitudinal axis of the upright pole to a lowered position below the raised position relative to the longitudinal axis of the upright pole, the second configuration corresponding to the upper pole portion and the lower pole portion being tilted relative to each other and the first configuration corresponding to the upper pole portion and the lower pole portion being axially aligned;

wherein the second mechanism further comprises:

an upper coupler attached with the upper pole portion;

a lower coupler attached with the lower pole portion;

the upper coupler and the lower coupler attached at a pivot;

a guide track assembly comprising the channel member having the channel, the channel having a camming surface disposed in the upper coupler; the driver having an upper end and a lower end, the upper end disposed in the guide track assembly and configured to be guided by the channel, the lower end coupled with the actuator by a tension member;

wherein from the first configuration, downward movement of the driver engages the upper end of the driver with the camming surface and tilts the upper pole portion relative to the lower pole portion about the pivot; and wherein from the second configuration, upward movement of the driver engages the upper end of the driver with the camming surface and aligns the upper pole portion relative to the lower pole portion.

2. The umbrella of claim 1, wherein the second mechanism further comprises a spring, the spring configured to bias the second mechanism in the first configuration.

3. The umbrella of claim 1, wherein the second mechanism further comprises an upper coupler and a lower coupler, the upper coupler coupled to the upper pole portion and the lower coupler coupled to the lower pole portion, wherein the upper coupler and lower are pivotally coupled together.

4. An umbrella comprising:

an upright pole, the upright pole comprising an upper pole portion and a lower pole portion;

a canopy assembly comprising the upper pole portion;

a first mechanism for opening and closing the canopy assembly;

a second mechanism for adjusting an angle between the upper pole portion and the lower pole portion, the second mechanism comprising a driver having an end disposed in a channel of a channel member, the channel guiding the end of the driver disposed therein; and an actuator for the second mechanism, the actuator coupled with the lower pole portion and configured to adjust the second mechanism from a first configuration to a second configuration when the actuator is lowered, the second configuration being tilted relative to the first configuration, wherein the actuator comprises:

a sleeve slidingly engaged with the upright pole between a raised position and a lowered position, the sleeve coupled with the second mechanism by a tension member, the sleeve comprising an upper sleeve portion and a lower sleeve portion, the upper sleeve portion and the lower sleeve portion coupled together by a sliding catch;

a hook member coupled with the lower sleeve portion, the hook member biased to engage with a catch in the lowered position of the sleeve;

an internal projection extending from the upper sleeve portion, the internal projection configured to engage with an angled end of the hook member;

wherein relative movement of the upper sleeve portion relative to the lower sleeve portion engages the internal projection with the angled end of the hook member to release the hook member from the catch;

wherein moving the sleeve into the lowered position actuates the second mechanism into the second configuration; and wherein releasing the sleeve from the lowered position by movement of the upper sleeve portion relative to the lower sleeve portion returns the second mechanism into the first configuration.

5. The umbrella of claim 4, wherein the relative movement of the upper sleeve portion is upward movement.

6. An umbrella comprising:

an upright pole, the upright pole comprising an upper pole portion and a lower pole portion;

a canopy assembly comprising the upper pole portion;

a first mechanism for opening and closing the canopy assembly;

a second mechanism for adjusting an angle between the upper pole portion and the lower pole portion, the second mechanism comprising a driver having an end disposed in a channel of a channel member, the channel guiding the end of the driver disposed therein; and an actuator for the second mechanism, the actuator coupled with the lower pole portion and configured to adjust the second mechanism from a first configuration to a second configuration when the actuator is lowered, the second configuration being tilted relative to the first configuration, wherein the actuator comprises:

a grip handle configured to be moved between a raised position and a lowered position, the grip handle coupled with the second mechanism;

wherein moving the grip handle into the lowered position actuates the second mechanism into the second configuration; and wherein releasing the grip handle from the lowered position returns the second mechanism into the first configuration.

7. The umbrella of claim 6, wherein the movement of the grip handle from the lowered position to the raised position disengages a locking device disposed within an inner space of the grip handle.

8. An umbrella comprising:

an upright pole, the upright pole comprising an upper pole portion and a lower pole portion;

a canopy assembly comprising the upper pole portion;

a first mechanism for opening and closing the canopy assembly;

a second mechanism for adjusting an angle between the upper pole portion and the lower pole portion, the second mechanism comprising a driver having an end disposed in a channel of a channel member, the channel guiding the end of the driver disposed therein; and an actuator for the second mechanism, the actuator coupled with the lower pole portion and configured to adjust the second mechanism from a first configuration to a second configuration when the actuator is lowered, the second configuration being tilted relative to the first configuration;

wherein the driver further comprises a second end opposite the end disposed in the channel of the channel member, the second end configured to couple with a drive rod or cord, wherein the drive rod or cord is configured to exert a downward force on the driver to adjust the second mechanism to the second configuration, and wherein the second mechanism further comprises a spring configured to apply a force on the drive rod or cord to adjust the second mechanism from the second configuration to the first configuration.

* * * * *